US007189934B2

(12) United States Patent
Youngner

(10) Patent No.: US 7,189,934 B2
(45) Date of Patent: Mar. 13, 2007

(54) SELF-HEALING LIQUID CONTACT SWITCH

(75) Inventor: Daniel W. Youngner, Maple Grove, MN (US)

(73) Assignee: Honeywell International Inc., Morristown, NJ (US)

( * ) Notice: Subject to any disclaimer, the term of this patent is extended or adjusted under 35 U.S.C. 154(b) by 218 days.

(21) Appl. No.: 10/749,255

(22) Filed: Dec. 31, 2003

(65) Prior Publication Data

US 2005/0104693 A1 May 19, 2005

Related U.S. Application Data

(63) Continuation-in-part of application No. 10/712,444, filed on Nov. 13, 2003.

(51) Int. Cl.
*H01H 29/00* (2006.01)

(52) U.S. Cl. ..... 200/182; 200/187; 200/215; 200/219; 200/235; 200/236; 335/47; 335/48; 335/55; 335/57; 335/58

(58) Field of Classification Search ..... 200/182, 200/187–189, 214–216, 219, 233, 234, 235, 200/236; 335/47–50, 55–58, 151–154
See application file for complete search history.

(56) References Cited

U.S. PATENT DOCUMENTS 3,327,263 A * 6/1967 Korn ..... 335/154
3,488,760 A * 1/1970 Loebe ..... 335/154
3,787,647 A 1/1974 Hughes (Continued)

FOREIGN PATENT DOCUMENTS

FR 2402941 4/1979

(Continued)

OTHER PUBLICATIONS

Nattland, et al., "Interfacial Properties of Liquid Alloys: An Experimental Study on Ga-Bi and Ga-Ge," Phys. Chem. 102, No. 9, pp. 1151-1155, 1998.

(Continued)

*Primary Examiner*—Ramon M. Barrera
(74) *Attorney, Agent, or Firm*—McDonnell Boehnen Hulbert & Berghoff LLP

(57) ABSTRACT

A self-healing liquid contact switch and methods for producing such devices are disclosed. An illustrative self-healing liquid contact switch can include an upper actuating surface and a lower actuating surface each having a number of liquid contact regions thereon configured to wet with a liquid metal. The upper and lower actuating surfaces can be brought together electrostatically by an upper and lower actuating electrode. During operation, the liquid metal can be configured to automatically rearrange during each actuating cycle to permit the switch to self-heal.

62 Claims, 16 Drawing Sheets

U.S. PATENT DOCUMENTS

| | | | | |
|---|---|---|---|---|
| 3,959,694 | A * | 5/1976 | Walsh | 361/120 |
| 4,368,442 | A * | 1/1983 | Yamaguchi et al. | 335/57 |
| 4,970,356 | A | 11/1990 | Amos | |
| 5,478,978 | A | 12/1995 | Taylor et al. | |
| 6,323,447 | B1 | 11/2001 | Kondoh et al. | |
| 6,373,356 | B1 | 4/2002 | Gutierrez et al. | |
| 6,396,371 | B2 | 5/2002 | Streeter et al. | |
| 6,501,354 | B1 | 12/2002 | Gutierrez et al. | |
| 6,587,021 | B1 | 7/2003 | Streeter | |
| 6,720,507 | B2 * | 4/2004 | Wong et al. | 200/182 |
| 6,743,991 | B1 * | 6/2004 | Wong et al. | 200/182 |
| 6,759,610 | B1 * | 7/2004 | Dove et al. | 200/182 |
| 6,924,443 | B2 * | 8/2005 | Wong et al. | 200/182 |
| 2001/0048353 | A1 | 12/2001 | Streeter et al. | |
| 2002/0105396 | A1 | 8/2002 | Streeter et al. | |
| 2003/0015409 | A1 | 1/2003 | Narasimhan | |
| 2003/0075428 | A1 | 4/2003 | Takenaka | |
| 2003/0184476 | A1 | 10/2003 | Sikina et al. | |
| 2003/0234167 | A1 | 12/2003 | Kondoh et al. | |
| 2004/0084395 | A1 | 5/2004 | Youngner et al. | |

FOREIGN PATENT DOCUMENTS

| | | |
|---|---|---|
| GB | 861653 | 2/1961 |
| GB | 906602 | 9/1962 |

OTHER PUBLICATIONS

Brown, Elliott R., "RF-MEMS Switches for Reconfigurable Integrated Circuits," IEEE Transactions on Microwave Theory and Techniques, vol. 46 No. 11, pp. 1868-1880, Nov. 1998.

Kim, J., et al., "Mecury Contact Micromechanical Relays," Proceeding 46th Annual International Relay Conference, Oak Brook, IL., pp. 191-19-8, Apr. 1998.

http://www.globalsecurity.org/military/systems/munitions/cm-gps.htm, Low Cost Competent Munitions [LCCM], 4 pages, printed Dec. 31, 2003.

* cited by examiner

SELF-HEALING LIQUID CONTACT SWITCH

This application is a Continuation-In-Part of co-pending U.S. patent application Ser. No. 10/712,444, filed on Nov. 13, 2003, and entitled, "Thin-Film Deposition Methods and Apparatuses."

FIELD OF THE INVENTION

The present invention relates generally to the field of switching devices. More specifically, the present invention pertains to the design and fabrication of liquid contact switches having self-healing capabilities.

BACKGROUND OF THE INVENTION

Conventional solid-state switching devices such as RF switches, PIN switches, MESFET switches, and mechanical relays are used in a wide array of applications to control the conveyance and routing of electrical signals. In the field of microelectromechanical system (MEMS) devices, for example, such switching devices are used to perform rapid switching between RF and microwave signals in a phased array antennae or other phase shifting device. Such switching devices are also frequently used in the design of passive bandwidth microwave and RF filters, guidance systems, communication systems, avionics and space systems, building control systems (e.g. HVAC systems), process control systems, and/or other applications where rapid signal switching is typically required or desired.

The failure of many conventional switching devices remains a significant obstacle in the field, limiting both the reliability and actuation speed of the device. In the design of MEMS RF switches, for example, the repeated actuation of solid metal contacting surfaces can cause the device to fail or become unstable after a relatively short period of time (e.g. about 100 million cycles). In certain cases, failure of the device is caused by the presence of electrical arcs or sparks between the electrostatically actuated contact surfaces. Such arcing can cause the metal on the surfaces to melt and/or pit, causing stiction within the switch that can reduce contact reliability. Irregularities in the actuating surfaces can also cause jitter, resulting in variable switching times and an increase in the pull away force necessary to open the switch. In certain cases, the shape of the contact surfaces can also cause contact bounce, further reducing the efficacy of the device during operation. Other factors such as contact resistance (i.e. insertion loss), harmonics, parasitic oscillations, shock resistance, and temperature resistance may also limit the effectiveness of many prior-art switching devices.

SUMMARY OF THE INVENTION

The present invention pertains to the design and fabrication of liquid contact switches having self-healing capabilities. A self-healing liquid contact switch in accordance with an illustrative embodiment of the present invention may include an upper actuating surface and a lower actuating surface each including a number of wetable traces and circular or other shaped liquid contact regions that can be brought together by electrostatic actuation. The switch can be electrostatically actuated using an upper and lower actuating electrode configured to reduce contact bounce and pull-away force. In certain embodiments, for example, a custom sloped surface formed on the lower actuating electrode can permit the upper actuating electrode to be initially actuated with a relatively small voltage, and then rolled down the sloped surface to provide the desired displacement to actuate the switch. A number of spacer elements on the lower and/or upper actuating electrode can be used to prevent the upper and lower actuating surfaces from physically contacting each other during actuation.

The liquid contact regions can include a wetable surface adapted to wet with a liquid metal such as gallium that can be used to electrically activate the switch when the upper and lower actuating surfaces are brought closer together. The wetable traces and liquid contact regions can be arranged in a particular manner on the upper and/or lower actuating surfaces, forming a patterned array extending from an outer periphery of the actuating surface to an inner portion thereof. In certain embodiments, for example, the wetable traces and liquid contact regions can be arranged in a patterned array of linearly converging lines with each liquid contact region gradually increasing in size towards the inner portion of the actuating surface. In other embodiments, the wetable traces and liquid contact regions can be arranged in a spiraling pattern with each liquid contact region gradually increasing in size towards the inner portion of the spiral. During actuation, the liquid metal can be configured to automatically migrate inwardly towards the inner portion of the actuating surfaces by surface tension and by a process atomic recapture, allowing the switch to self-heal during each actuation cycle. In certain embodiments, one or more optional heater elements can be employed to induce thermophoresis within the upper and lower actuating surfaces, further causing the liquid metal to migrate inwardly during each actuation cycle.

An illustrative method of forming a self-healing liquid contact switch in accordance with the present invention may begin with the step of providing a custom slope etch within the surface of a substrate. Once formed therein, a number of further processing steps can be performed to form the upper and lower actuating electrodes and the upper and lower actuating surfaces of the switch. In one illustrative embodiment, a number of wetable traces and liquid contact regions can be formed above the substrate, allowing the deposition of a liquid metal. To prevent oxidation, the liquid metal can be encapsulated within a thin layer of tungsten or other suitable material that can be later removed to liberate the liquid metal. In certain embodiments, for example, a laser beam can be directed through the surface of a transparent substrate to ablate the encapsulating layer once the switch has been hermetically sealed. In other embodiments, heat generated from one or more heating elements can be used to thermally ablate the encapsulating layer once the switch has been hermetically sealed.

DETAILED DESCRIPTION OF THE INVENTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

Figure 1:
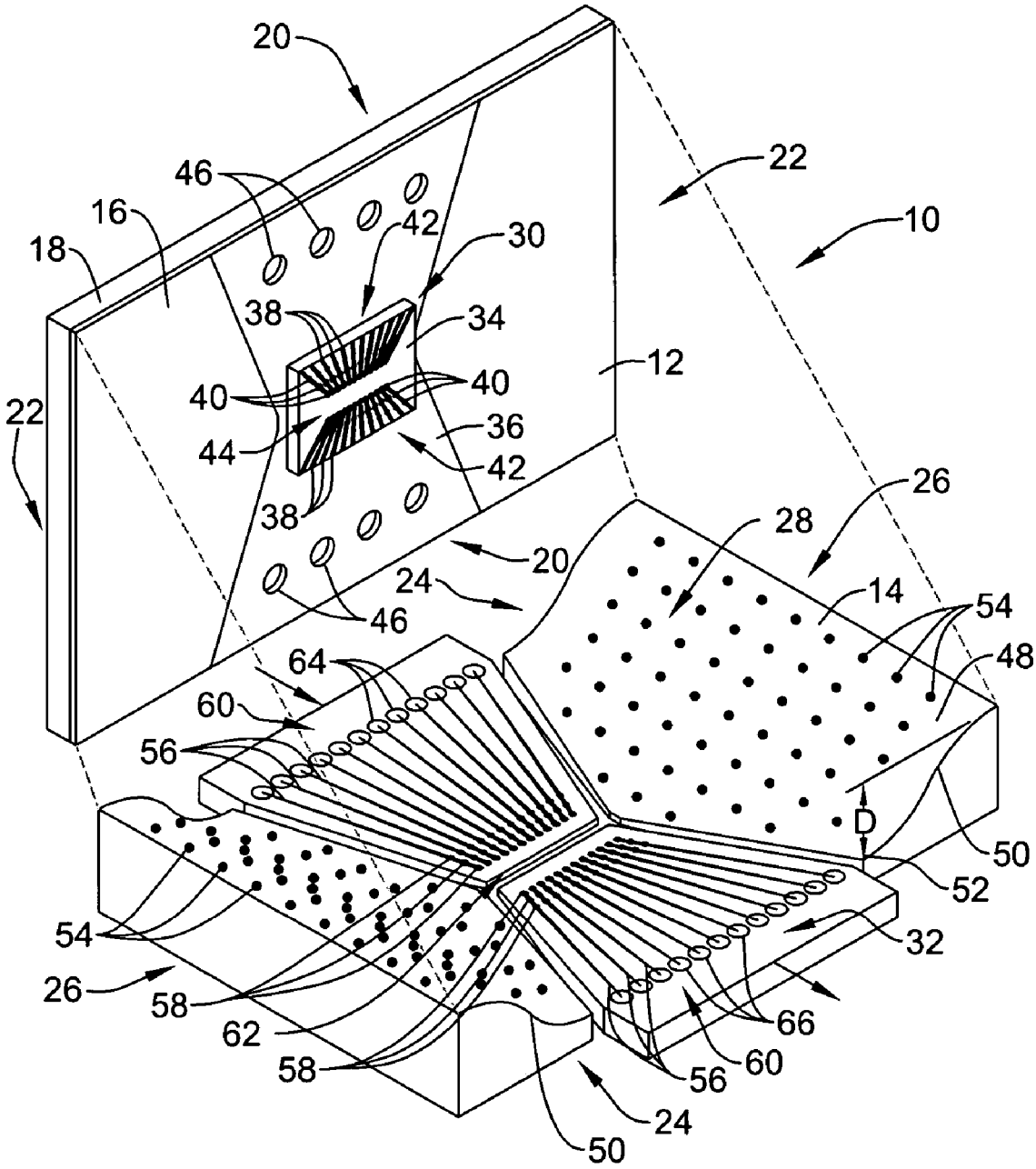
FIG. 1 is a diagrammatic view of a self-healing liquid contact switch in accordance with an illustrative embodiment of the present invention.

FIG. 1 is a diagrammatic view of a self-healing liquid contact switch 10 in accordance with an illustrative embodiment of the present invention. Switch 10, illustratively a microelectromechanical system (MEMS) RF switch, includes an upper actuating electrode 12 and a lower actuating electrode 14 that can be hermetically sealed within an enclosure (not shown) containing, for example, argon gas. In the particular view depicted in FIG. 1, the upper and lower actuating electrodes 12,14 are shown detached from each other for sake of clarity, with some features being partially removed or hidden for clarity.

The upper actuating electrode 12 can include one or more metal layers 16 coupled to a base layer 18 of material. In certain embodiments, for example, the upper actuating electrode 12 may include a layer of tungsten or other non-wetable metal coupled to a base layer of silicon nitride (SiN). In the illustrative embodiment of FIG. 1, the upper actuating electrode 12 has a substantially rectangular shape defining a number of sides 20 and ends 22. As indicated by dashed lines, the sides 20 and ends 22 on the upper actuating electrode 12 are configured to align and mate with a number of sides 24 and ends 26 defined by the lower actuating electrode 14. When fully assembled, the various sides 20,24 and ends 22,26 of the upper and lower actuating electrodes 12,14 define an internal chamber 28 within the switch 10. In use, an electrostatic charge can be induced between the upper and lower actuating electrodes 12,14, causing the upper actuating electrode 12 to move back and forth in a particular manner within the internal chamber 28.

An upper actuating surface 30 coupled to the upper actuating electrode 12 can be used to short a corresponding lower actuating surface 32 on the lower actuating electrode 14. The upper actuating surface 30 can include a metal boss plate 34 disposed adjacent to a layer 36 of SiN or other suitable dielectric material, forming an upper diaphragm of the switch 10. In certain embodiments, for example, the boss plate 34 can be formed at least in part from a non-wetable metal such as tungsten that resists wetting of certain types of liquid metals such as liquid gallium.

Disposed on the boss plate 34 are a number of wetable traces 38 and circular or other shaped liquid contact regions 40 that can be used to make electrical contact between the upper and lower actuating surfaces 30,32. The liquid contact regions 40 can be arranged closely together and in increasing size from an outer periphery 42 of the boss plate 34 to an inner portion 44 thereof. In certain embodiments, the wetable traces 38 and liquid contact regions 40 can be formed in a patterned array of linearly converging lines each gradually increasing in width towards the inner portion 44.

Unlike the material forming the boss plate 34, the wetable traces 38 and liquid contact regions 40 are formed from a wetable material that wets well with certain types of liquid metals. In one such embodiment, for example, the wetable traces 38 and/or liquid contact regions 40 can be formed from a platinum material, which wets well with liquid gallium. Gallium is considered a particularly useful material based on its relatively low melting point (i.e. <30° C.), and since it is able to undergo substantial heating with relatively low levels of evaporation. Gallium is also desirable over other liquid metals used in the art such as mercury, which require additional safety precautions during manufacturing and disposal. It should be understood, however, that other liquid materials could be utilized, if desired.

The upper actuating surface 30 may further define a number of openings 46 that allow the deposition of liquid metal (e.g. gallium) within the internal chamber 28. The openings 46 can be located at or near sides 20 of the upper actuating electrode 12, allowing deposition of liquid material onto the lower actuating surface 28 during fabrication. In certain embodiments, the openings 46 can be formed by laser drilling holes through the upper actuating surface 30, or by some other desired method.

The lower actuating electrode 14 can include a custom shaped slope that allows the upper actuating electrode 12 to be initially actuated with a relatively small voltage, and then rolled down the sloped surface to provide the desired displacement to actuate the switch 10. In the illustrative embodiment of FIG. 1, for example, a custom sloped surface 48 formed on the lower actuating electrode 14 can be configured to gradually slope from a location at or near the ends 26 of the lower actuating electrode 14 towards the interior thereof, forming two S-shaped slope regions 50. In use, the S-shaped slope regions 50 reduce the amount of contact bounce between the two actuating electrodes 12,14, thereby increasing the actuation speed of the switch 10. The S-shaped slope regions 50 also help to reduce the amount of power required to operate the switch 10 by reducing the pull away force required to displace the upper actuating electrode 12 away from the lower actuating electrode 14.

A bottom portion 52 of the sloped surface 48 can also be recessed a sufficient depth D to prevent the occurrence of stiction between the upper and lower actuating electrodes 12,14. In certain embodiments, for example, the bottom portion 52 of the sloped surface 48 can be recessed a depth D of about 4 to 8 microns, providing a sufficient distance for the upper actuating electrode 12 to displace. To further prevent undesired contact between the upper and lower actuating surfaces 30,32, switch 10 can also include a number of spacer elements 54 formed on the upper and/or lower actuating electrodes 12,14. In certain embodiments, for example, the spacer elements 54 can include a number of protrusive dots formed in a pattern on the sloped surface 48 of the lower actuating electrode 14. The spacer elements 54 can include a material such as silicon nitride (SiN) that prevents the upper and lower actuating surfaces 30,32 from physically contacting each other when brought together.

Switch 10 may further include getter (e.g. titanium) configured to capture residual oxygen, water, or other oxidizing gases contained within the switch enclosure. In certain embodiments, for example, a pattern of gettering dots (not shown) can be formed at various locations in the switch 10, typically at a location away from the upper and lower actuating surfaces 30,32. The gettering dots can be formed by depositing small, encapsulated gettering dots at one or more locations within the switch 10, and then laser melting and/or heating the encapsulated getter dots once the switch 10 has been hermetically sealed to release the fresh getter.

The lower actuating surface 32 can include a number of wetable traces 56 and circular or other shaped liquid contact regions 58 corresponding in size and shape with the wetable traces 38 and liquid contact regions 40 disposed on the upper actuating surface 30. The wetable traces 56 may extend in a linearly convergent manner from an outer periphery 60 of the lower actuating surface 32 to an inner portion 62 thereof. As with the wetable traces 38 on the upper actuating surface 30, the wetable traces 56 can be tapered to scavenge liquid metal from the outer periphery 60. A number of input terminals 64 coupled to the wetable traces 38 can be configured to receive an RF signal, which, when switch 10 is closed, can be delivered to a number of output terminals 66 located on the opposite side of the lower actuating surface 32.

Figure 2:
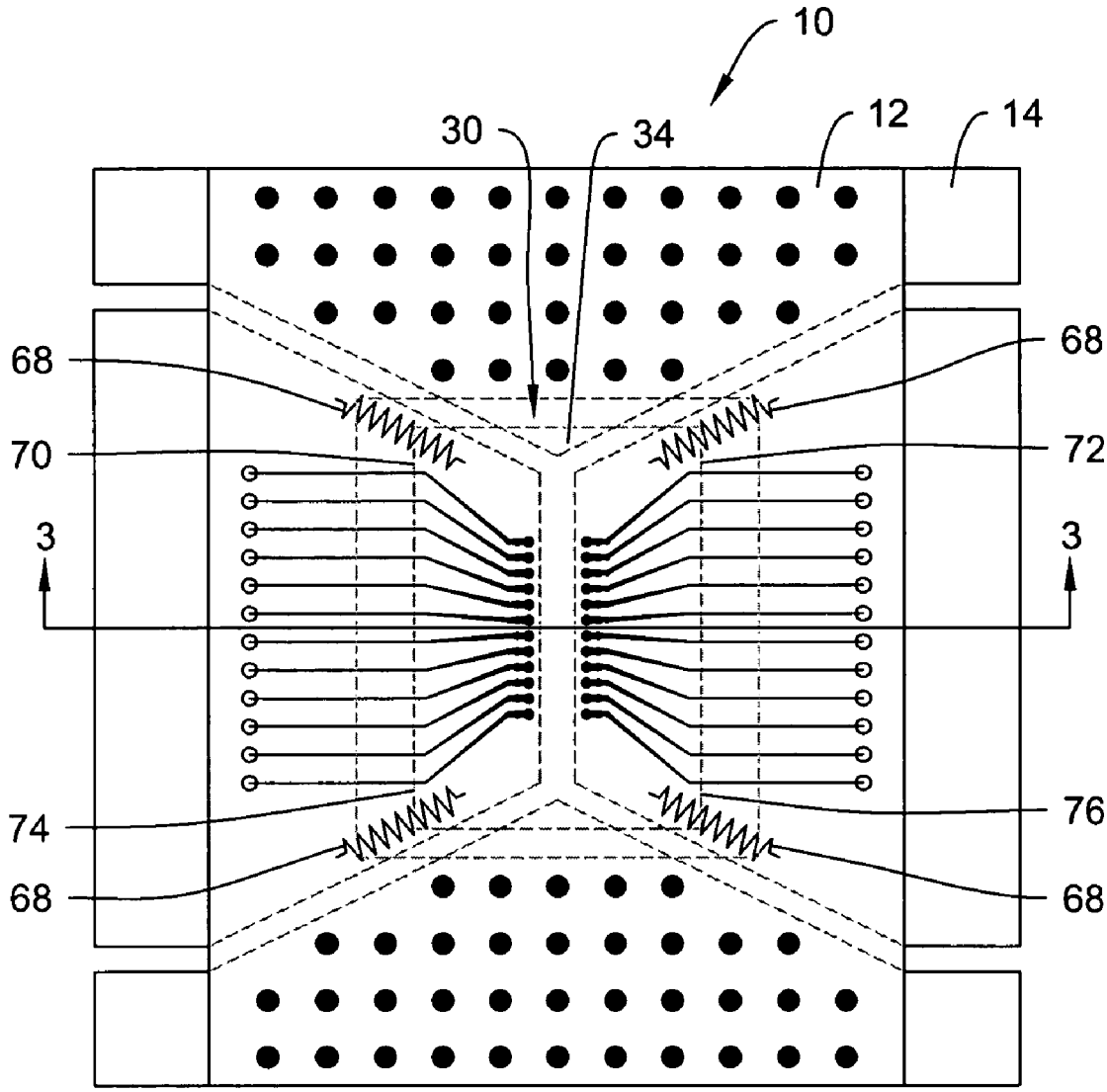
FIG. 2 is a top plan view of the self-healing liquid contact switch of FIG. 1, showing the juxtaposition of the upper actuating electrode over the lower actuating electrode.

FIG. 2 is a top plan view of the self-healing liquid contact switch 10 of FIG. 1, showing the juxtaposition of the upper actuating electrode 12 over the lower actuating electrode 14. As can be seen in FIG. 2, switch 10 may further include one or more optional heater elements 68 (e.g. heating resistors) configured to heat the upper and lower actuating surfaces 30,32 to induce thermophoresis. The heater elements 68 can be operatively connected to the upper and/or lower actuating electrodes 12,14 in any number of desired arrangements to form a particular temperature gradient within the switch 10. In the illustrative embodiment depicted in FIG. 2, for example, four heater elements 68 are located adjacent to the four corners 70,72,74,76 of the boss plate 34 on the underside of the upper actuating surface 30. The number and arrangement of the heater elements 68 could be altered, however, to produce other desired thermal gradients within the switch 10, as desired.

Figure 3:
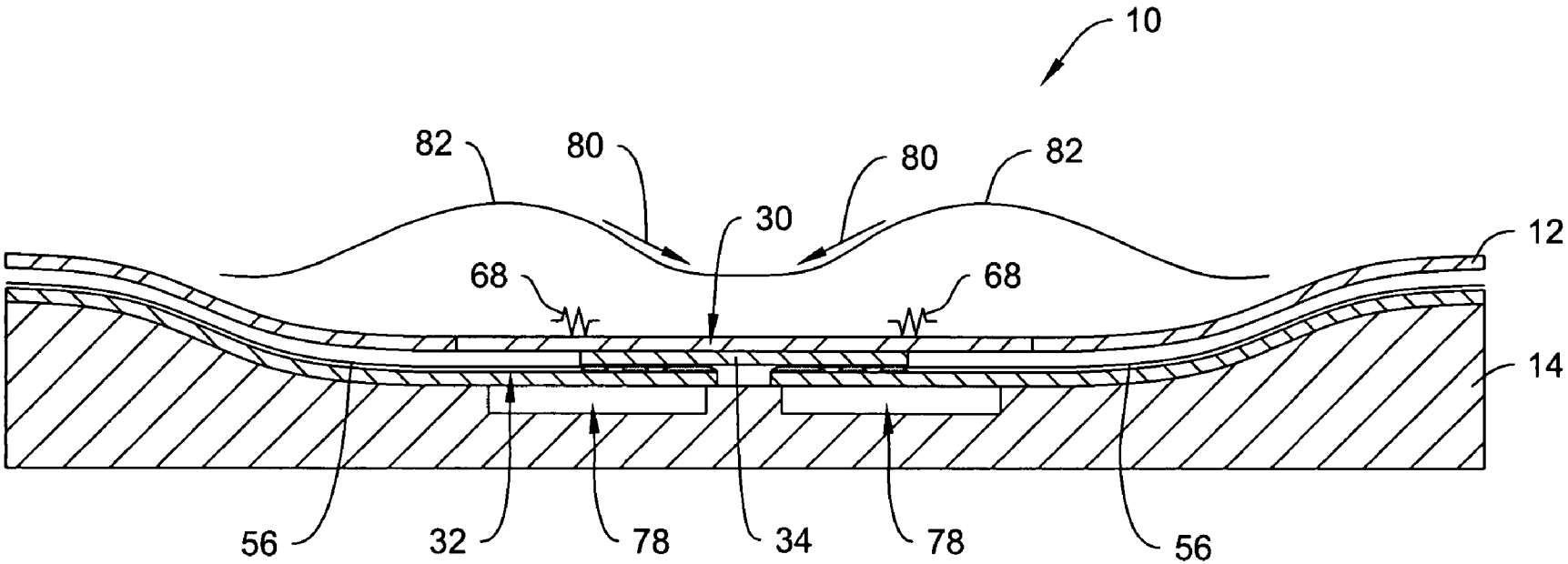
FIG. 3 is a cross-sectional view showing the self-healing liquid contact switch along line 3—3 in FIG. 2.

FIG. 3 is a cross-sectional view showing the self-healing liquid contact switch 10 along line 3—3 in FIG. 2. As shown in FIG. 3, one or more hollowed regions 78 can be formed within the lower actuating electrode 14 at a position below the inner portion of the lower actuating surface 32. When heat is applied by the one or more heater elements 68, a thermal gradient or profile is created within the upper and lower actuating surfaces 30,32, as indicated generally by the arrows 80. The thermal gradient spikes at the locations 82 in the immediate vicinity of the heater elements 68, and then tapers gradually towards the interior of the upper and lower actuating surfaces 30,32. The heat emitted from the heater elements 68 is further focused along the lower actuating surface 32 via the hollowed regions 78, which form areas of thermal isolation. During operation, the presence of a heat gradient within the region of the upper and lower actuating surfaces 30,32 forces the liquid metal to migrate inwardly during each actuation cycle through thermophoresis. In certain embodiments, the heat emitted can also be used to maintain the liquid metal in its liquid state during periods of non-use, or when the switch 10 is operated in cold environments.

Figure 4:
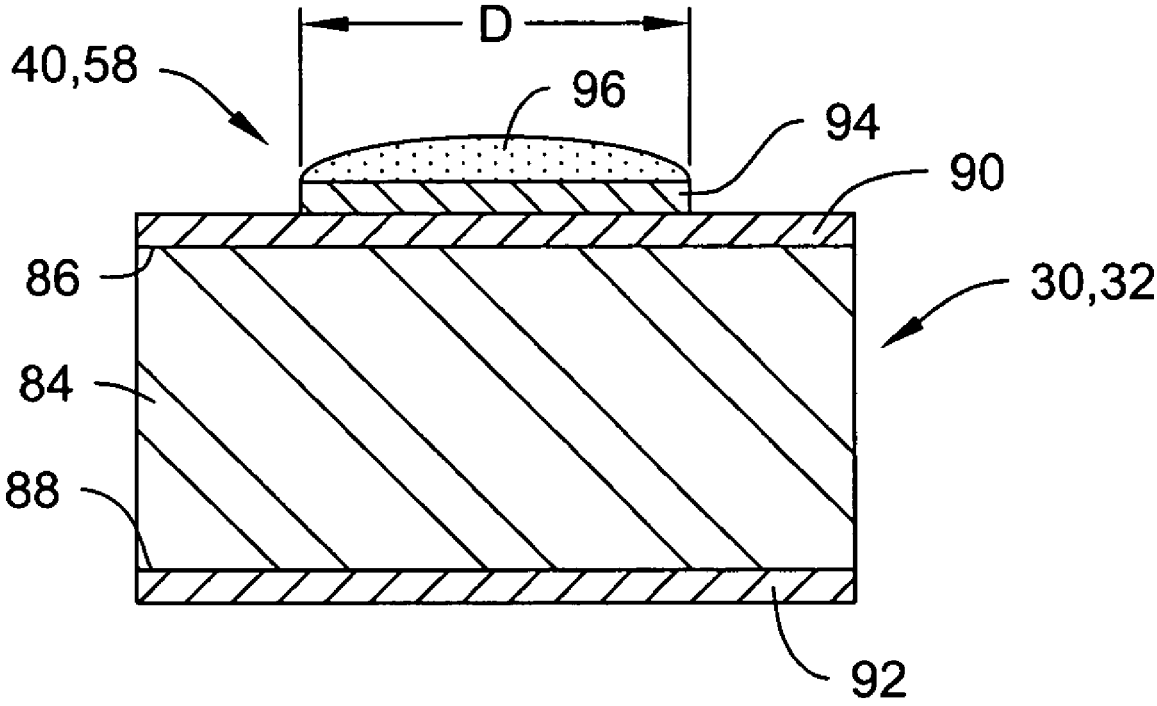
FIG. 4 is a cross-sectional view showing the configuration of the liquid contact regions on the upper and lower actuating surfaces of FIG. 1.

FIG. 4 is a cross-sectional view showing the configuration of the liquid contact regions 40 or 58 on the upper and lower actuating surfaces 30 and 32 of FIG. 1. As can be seen in FIG. 4, the upper and lower actuating surfaces 30 and 32 may each include a base layer 84 having a leading surface 86 and a trailing surface 88. In certain embodiments, the base layer 84 can be formed from an approximately 1 micron thick layer of silicon nitride (SiN) film. A relatively thin (e.g. 50 nm) outer layer 90 formed above the leading surface 86 of the base layer 84 includes a non-wetable material such as tungsten that resists wetting of certain types of liquid metals such as liquid gallium. In addition to forming a non-wetable surface that repels the presence of liquid metal on each of the upper and lower actuating surfaces 30,32, the outer layer 90 also acts as a barrier to help screen any electrostatic charge trapped within the base layer 84 caused during electrostatic actuation. A similar outer layer 92 formed on the trailing surface 88 can also be provided in certain embodiments, if desired.

As can be further seen in FIG. 4, each liquid contact region 40,58 also includes a wetable surface 94 adapted to wet with a semi-spherically shaped droplet of liquid metal 96 thereon. The wetable surface 94 should typically include a material that wets well with the particular liquid metal 96 utilized. In certain embodiments, for example, the wetable surface 94 can include a layer of platinum material, which is well suited for capturing certain types of liquid metals 100 such as liquid gallium or an alloy thereof.

The diameter D of the wetable surface 94 will typically vary depending on the location of the liquid contact region 40,58 within the pattern. In certain embodiments, for example, the diameter D of the wetable surface 94 can vary from 2 microns at or near the outer periphery 42,60 of the upper and lower actuating surfaces 30,32 to a size of 3 microns at or near the inner portions 44,62 thereof. In use, the increase in diameter D of the wetable surfaces 94 causes the droplets of liquid metal 96 to likewise increase in size since more surface area is available to wet.

Turning now to FIGS. 5A–5E, an illustrative actuation cycle for the upper and lower actuating surfaces 30,32 will now be described. In an initial position illustrated in FIG. 5A, the upper and lower actuating surfaces 30,32 are shown in an open or separated position with the liquid contact regions 40 on the upper actuating surface 30 separated from the liquid contact regions 58 on the lower actuating surface 32. In this position, the gap between the two actuating surfaces 30,32 is sufficiently large to prevent the droplets of liquid metal 96 from contacting each other, preventing the transmission of a signal through the switch 10.

Figure 5A:
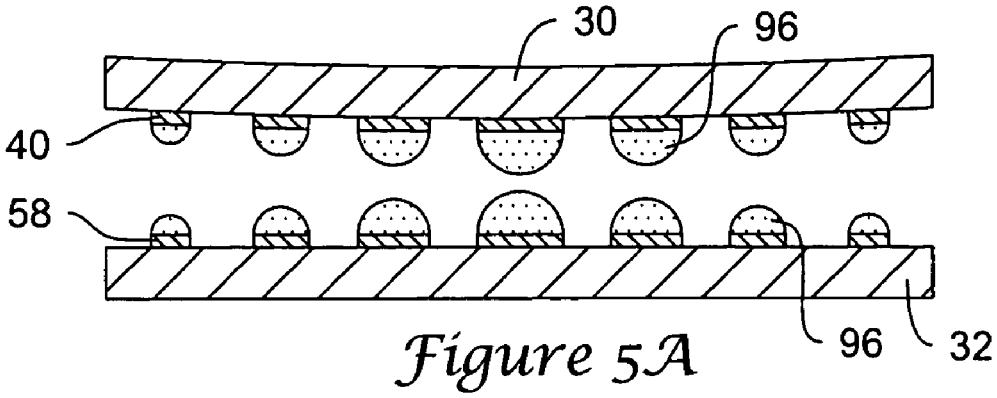
FIGS. 5A–5E are schematic views illustrating the process of atomic recapture for the self-healing liquid contact switch of FIG. 1.
Figure 5B:
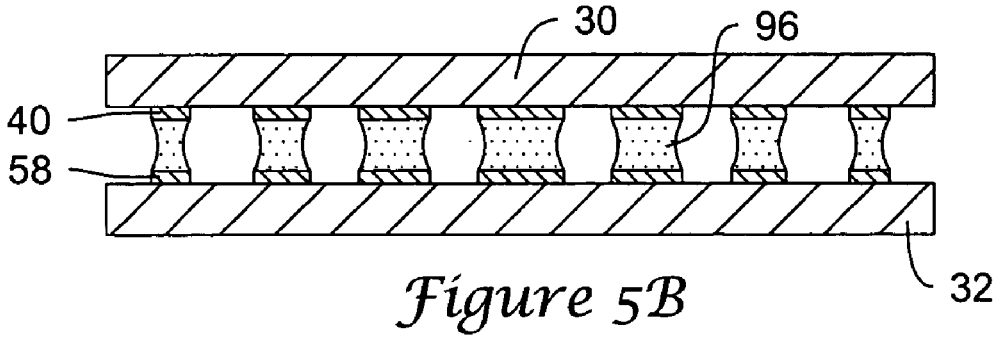

When a voltage is applied to the upper and lower actuating electrodes 12,14 (see FIG. 1), the upper and lower actuating surfaces 30,32 are brought closer together, causing the droplets of liquid metal 96 on the upper liquid contact regions 40 to come into electrical contact with the droplets of liquid metal 96 on the lower liquid contacts regions 58, as shown, for example, in FIG. 5B. When this occurs, the boss plate 36 (see FIG. 1) of the upper actuating surface 30 becomes shorted to both the input and output terminals 64,66 on the lower actuating surface 32, allowing an RF signal to be transmitted through the switch 10 (see FIG. 1).

Figure 5C:
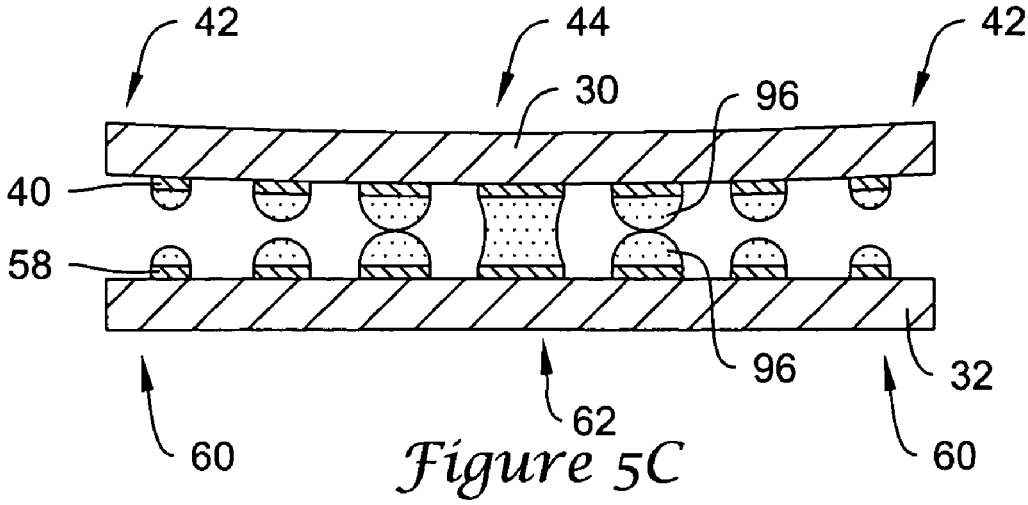

FIG. 5C is a third view showing the initial separation of the upper and lower actuating surfaces 30,32 upon opening the switch 10. As can be seen in FIG. 5C, the slope of the upper actuating surface 30 caused by the actuation of the upper actuating electrode 12 against the contoured surface 48 of the lower actuating electrode 14 causes the liquid contact regions 40,58 to pull apart beginning at the outer periphery 42,60, and then moving inwardly towards the inner portion 44,62 thereof (see FIG. 1). The ability of the switch 10 to open in this manner reduces the force necessary to pull away the two actuating surfaces 30,32, allowing the switch 10 to operate using less current than many conventional switching devices.

Figure 5D:
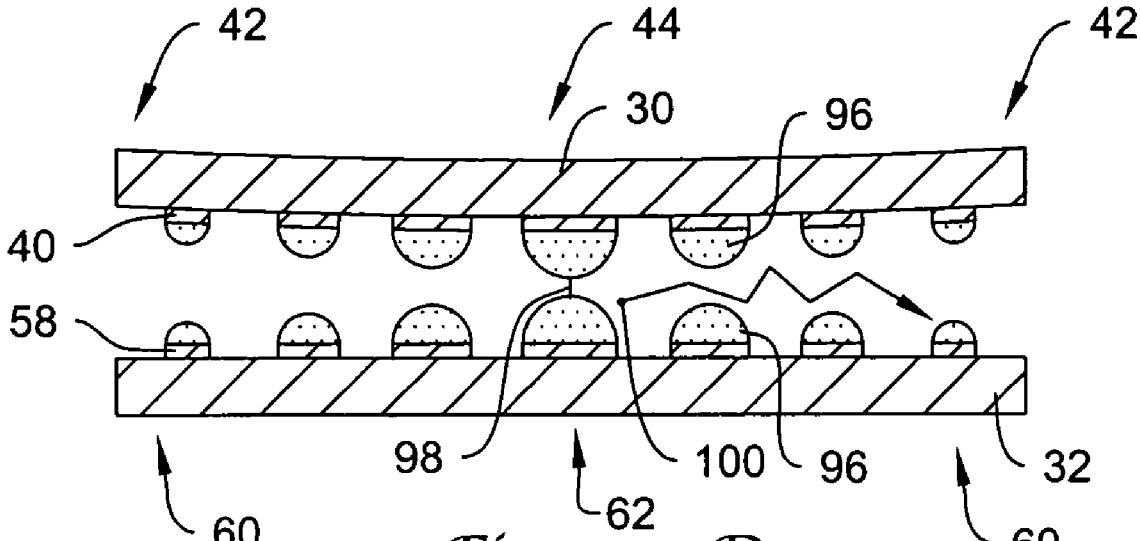
Figure 5E:
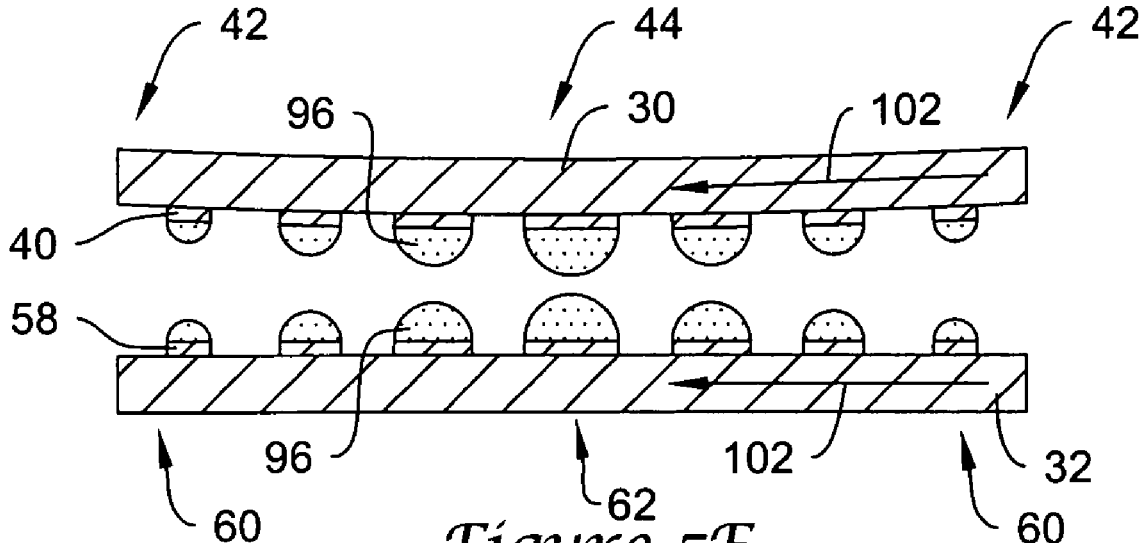

As the switch 10 is further opened, as shown, for example in FIG. 5D, an electric arc 98 may jump from the central liquid contact region 40,58 on one actuating surface 30,32 to the central liquid contract region 40,58 on the opposite actuating surface 30,32. This electric arc 98 forms a hot spot within the central liquid contact regions 40,58, causing some of the atoms 100 of the liquid metal 96 to evaporate and sputter towards the outer periphery 42,60 of the upper and lower actuating surfaces 30,32, as indicated by the arrows. Most or all of the liquid metal atoms 100 that are sputtered away from the central liquid contact regions 40,58 then collide with the argon gas contained between the upper and lower actuating surfaces 30,32, causing them to bounce off argon atoms contained within the switch enclosure until they are recaptured by one of the outer liquid contact regions 40,58. To help ensure that the liquid metal atoms 100 are atomically recaptured, the inert gas pressure within the enclosure and/or the geometry of the two actuating surfaces 30,32 should be made sufficient to prevent most or all of the liquid metal atoms 100 from being ejecting beyond the outer periphery 42,60 of the two actuating surfaces 30,32.

Once the liquid metal atoms 100 have been sputtered away from the central liquid contact regions 40,58, the various characteristics of the non-wetable and wetable surfaces act to automatically retrieve the liquid metal 96 towards the center of the upper and lower actuating surfaces 30,32. As can be seen by the arrows 102 in FIG. 5E, for example, the surface tension created by the slope of the upper actuating surface 30 encourages the liquid metal atoms 100 sputtered towards the outer liquid contact regions 40,58 to migrate inwardly to an equilibrium position similar to that depicted in FIG. 5A, replenishing the supply of liquid metal 96 in the center. Also, and as further described below with respect to FIGS. 6A–6E, the increasing size of the liquid contact regions toward the center of the structure may help encourage the liquid metal to migrate towards the center of the structure.

Because electrical contact between the two actuating surfaces 30,32 is made by the presence of liquid metal 96, and not the use of solid metal surfaces as accomplished by many convention switching devices, any pitting that occurs within the liquid metal 96 will immediately repair itself during each actuation cycle. Moreover, melting that can occur in the solid metal contact surfaces of some switching devices is also ameliorated since the electrical arc 98 is formed within the liquid metal 96 and not the upper and lower actuating surfaces 30,32. This results in an increase in contact reliability within the switch 10, in some cases allowing the switch 10 to be actuated more than 100 billion cycles.

In addition to the process of atomic re-capture illustrated generally in FIGS. 5A–5E, switch 10 can also be configured to self-heal through a surface rearrangement process depicted generally in FIGS. 6A–6E. In a first (i.e. open) position illustrated in FIG. 6A, a single droplet 104 of liquid metal 96 (e.g. gallium) is shown deposited onto one of the outer liquid contact regions 58 of the lower actuating surface 32. The single droplet 104 may be formed, for example, by the initial deposition of material through one of the openings 46 depicted in FIG. 1.

Figure 6A:
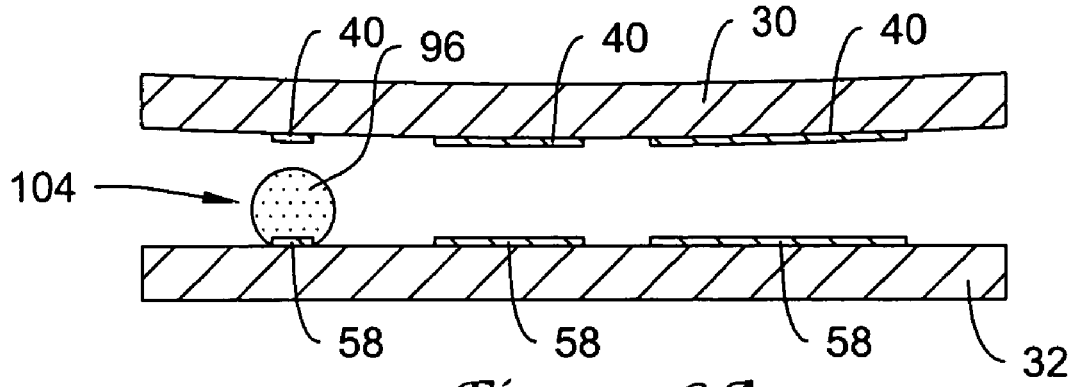
FIGS. 6A–6E are schematic views illustrating the process of surface rearrangement for the self-healing liquid contact switch of FIG. 1.
Figure 6B:
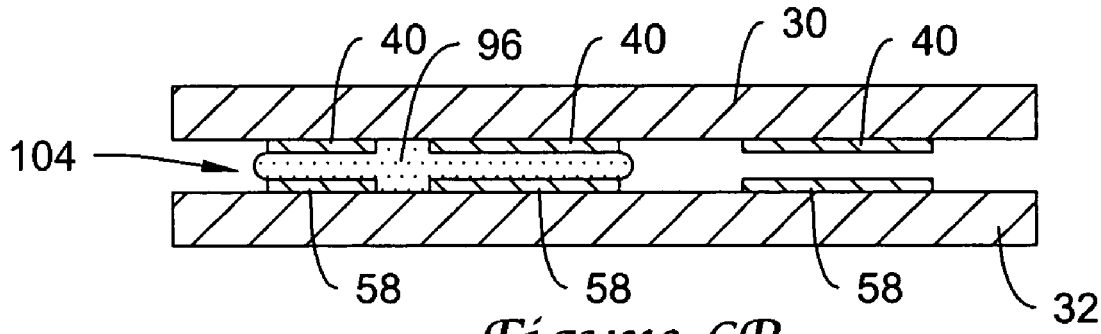
Figure 6C:
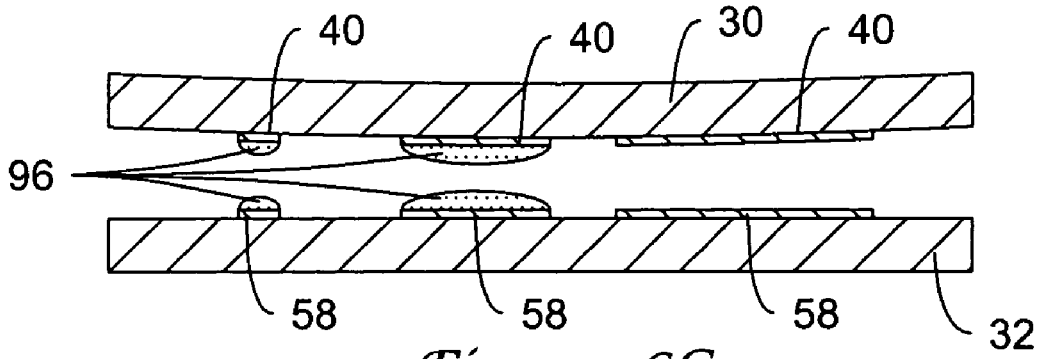

FIG. 6B illustrates the step of closing the switch 10 to bring the upper and lower actuating surfaces 30,32 together. As can be seen in FIG. 6B, as the two actuating surfaces 30,32 are brought together, the single droplet 104 of liquid metal 96 compresses and spreads outwardly towards one or more of the adjacent liquid contact regions 40,58, causing the liquid metal 96 to contact and adhere to those surfaces as well. When the upper and lower actuating surfaces 30,32 are drawn apart from each other, as shown in a subsequent view in FIG. 6C, the presence of the larger adjacent liquid contact regions 40,58 causes the droplet 104 to split and migrate inwardly towards the interior of the upper and lower actuating surfaces 30,32.

Figure 6D:
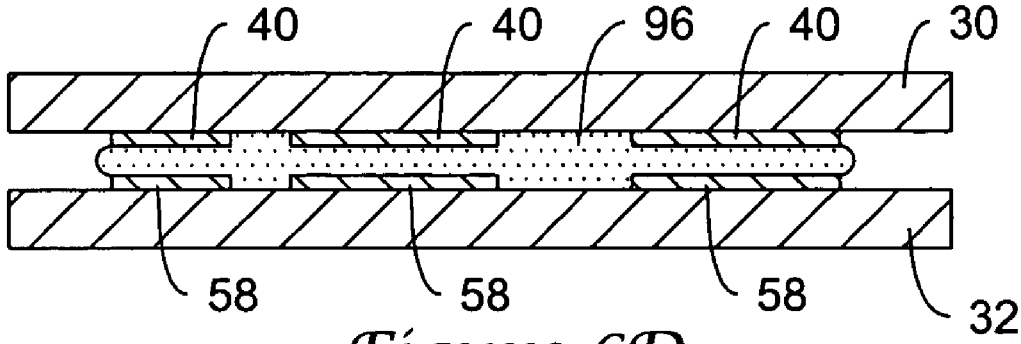
Figure 6E:
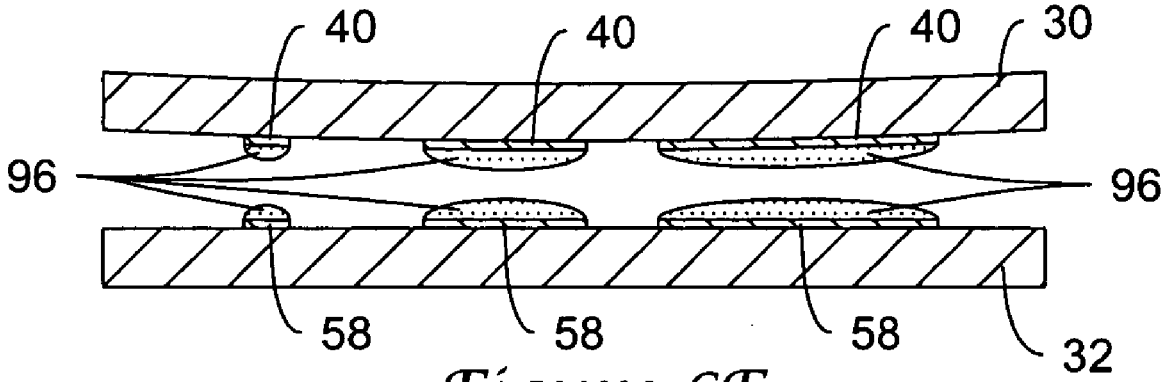

As can be further seen in FIGS. 6D–6E, the steps of closing and opening the switch can then be repeated, causing the droplets of liquid metal 96 to again split and migrate inwardly towards the next adjacent liquid contact region 40,58. Further repetition of this process causes the liquid metal 96 to be dispersed across the other liquid contact regions 40,58 until surface tension equilibrium is reached.

Figure 7A:
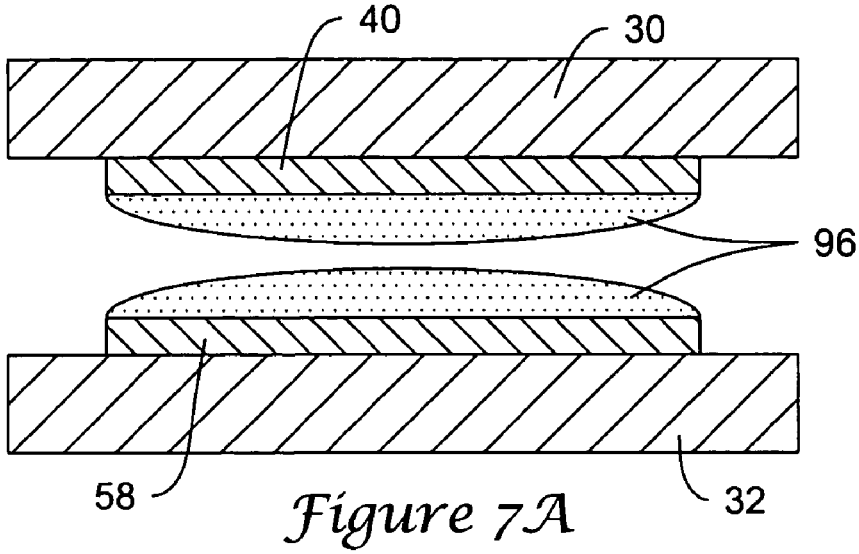
FIGS. 7A–7C are schematic views illustrating the deformation of liquid metal during actuation of the upper and lower actuating surfaces.
Figure 7B:
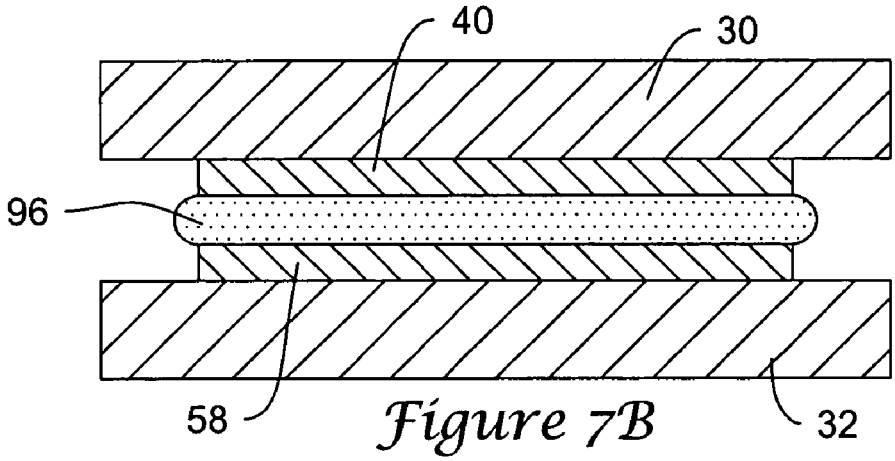
Figure 7C:
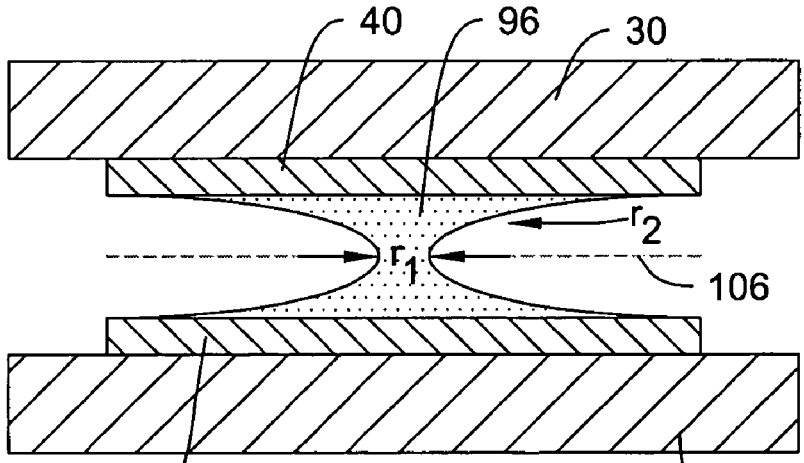

FIGS. 7A–7C are schematic views illustrating the deformation of the liquid metal 96 as it is compressed and subsequently drawn apart within the gap between the upper and lower actuating surfaces 30,32. As shown in an initially open position in FIG. 7A, the liquid metal 96 assumes a semi-spherical shape on the wetable surfaces of the liquid contact regions 40,58. The various shape characteristics (e.g. radius of curvature, thickness, diameter, etc.) of the liquid metal 96 will typically depend on the surface tension and quantity of liquid metal 96, which, in turn, is dependent in part on the dimensions of the liquid contact regions 40,58.

As can be seen in FIGS. 7B–7C, as the upper and lower actuating surfaces 30,32 are actuated from a closed position (FIG. 7B) to a partially open position (FIG. 7C), the elastic restoring force of the upper and lower actuating surfaces 30,32 tends to pull the liquid metal 96 apart, producing a negative pressure inside the liquid that causes the liquid metal 96 to constrict into the shape of a hyperbolic parabaloid of revolution about the symmetry axis defined generally by the dashed line 106. This internal pressure is governed generally by the formula $P=\gamma(1/r_1+1/r_2)$, wherein $\gamma$ is a constant relating to the specific type of liquid metal 96 employed. Since the internal pressure P can be well controlled by the selection of liquid properties within the liquid metal 96, the amount of jitter can be significantly reduced within the switch 10 over those prior-art switches that utilize solid metal contacting surfaces.

Figure 8:
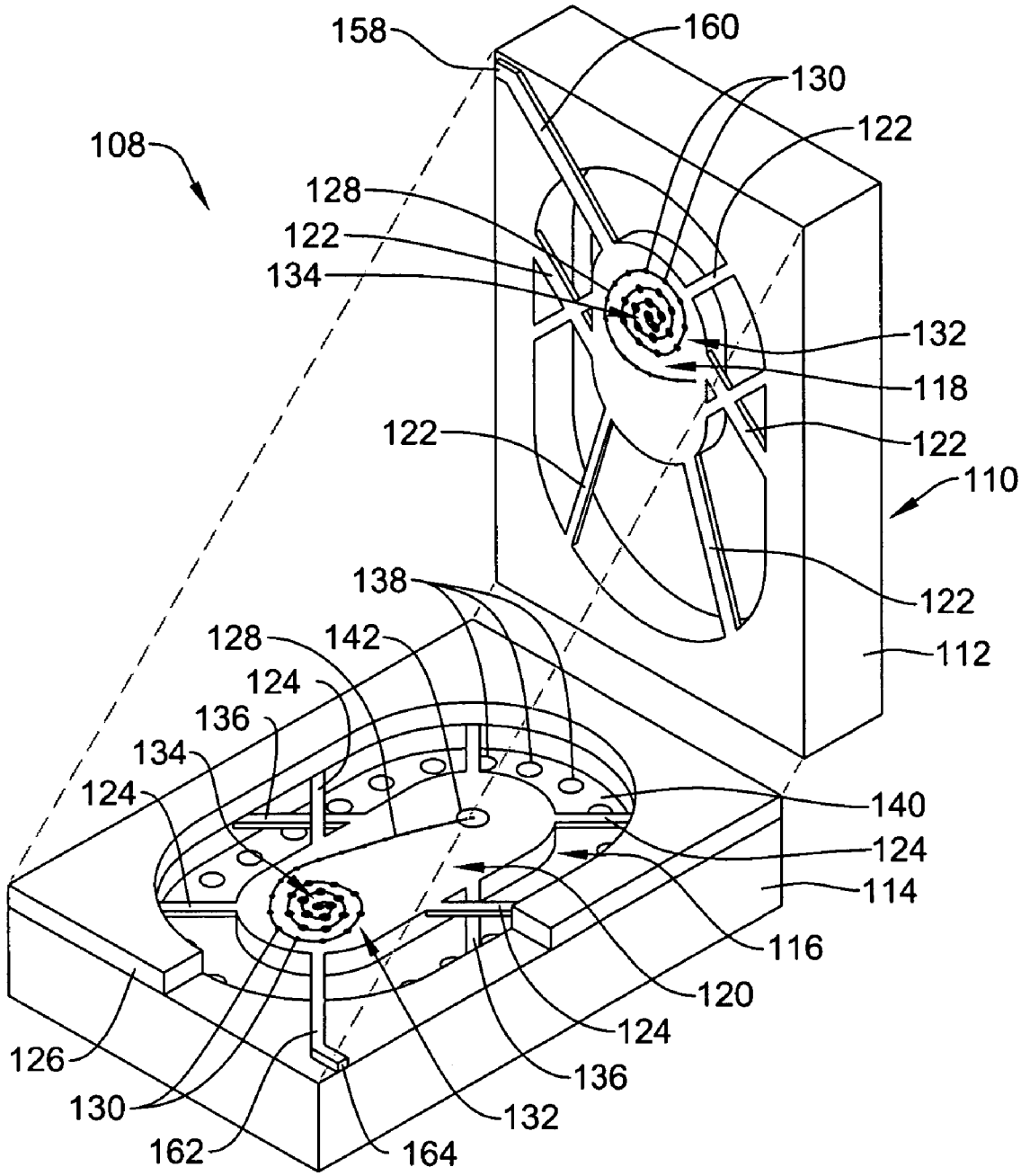
FIG. 8 is a diagrammatic view of a self-healing liquid contact switch in accordance with another illustrative embodiment of the present invention.

FIG. 8 is a diagrammatic view of a self-healing liquid contact switch 108 in accordance with another illustrative embodiment of the present invention. Switch 108, illustratively a microelectromechanical system (MEMS) RF switch, includes a hermetically sealed enclosure 110 having an upper switch cavity 112 and a lower switch cavity 114 defining an internal chamber 116 containing argon gas. An upper actuating surface 118 suspended within the upper switch cavity 112 forms an upper diaphragm that can be electrostatically engaged with a lower actuating surface 120 (i.e. a lower diaphragm) suspended within the lower switch cavity 114, causing the upper actuating surface 118 and/or lower actuating surface 120 to move back and forth in a particular manner within the internal chamber 116.

The upper actuating surface 118 can be supported by a series of support legs 122 that include electrodes (not shown) to electrically charge and actuate the upper actuating surface 118. In similar fashion, the lower actuating surface 120 can be supported by a second series of support legs 124 that include electrodes (not shown) to electrically charge and actuate the lower actuating surface 120. A spacer 126 (shown broken for clarity) disposed between the upper and lower switch cavities 112,114 can be used to provide a small gap between the upper and lower actuating surfaces 118,120 during the normally open state of the switch 108.

The upper and lower actuating surfaces 118,120 may each include a spiraled pattern of wetable traces 128 and circular or other shaped liquid contact regions 130 that can be used to make electrical contact between the upper and lower actuating surfaces 118,120. The liquid contact regions 130 can be arranged closely together and in increasing size from an outer periphery 132 of each actuating surface 118,120 to an inner portion 134 thereof. In certain embodiments, for example, the liquid contact regions 130 can vary from 2 microns at or near the outer periphery 132 of the upper and lower actuating surfaces 118,120 to a size of 3 microns at or near the inner portion 134 thereof.

Switch 108 may further include one or more optional heater elements 136 configured to heat the outer periphery 132 of the upper and/or lower actuating surfaces 118,120. As shown in FIG. 8, each of the one or more heater elements 136 may include a heater line that extends from the lower switch cavity 114 to the outer periphery 132 of the lower actuating surface 120. When activated, the one or more heater elements 136 can be used to create a thermal gradient or profile within the upper and lower actuation surfaces 118,120 that further cause the liquid metal to migrate inwardly around the spiraling pattern of wetable traces 128 and liquid contact regions 130. In certain embodiments, the heat emitted can also be used to maintain the liquid metal in its liquid state during periods of non-use, or when the switch 108 is operated in cold environments.

A number of gettering dots 138 on an interior surface 140 of the lower switch cavity 114 can be used to capture residual oxygen, water, or other oxidizing gases contained within internal chamber 116 of the switch enclosure 110. The gettering dots 138 can be formed by depositing small, encapsulated getter dots in a pattern onto the interior surface 140, and then laser melting and/or heating the encapsulated getter dots once the upper and lower switch cavities 112,114 have been hermetically sealed to release the fresh getter.

Insertion of the liquid metal used to make electrical contact between the upper and lower actuating surfaces 118,120 can be accomplished at location 142, where the lower wetable trace 128 begins to spiral towards the interior 134 of the lower actuating surface 120. As is discussed in greater detail below with respect to FIGS. 10A–10O, an encapsulated droplet of liquid metal can be initially deposited at this location 142 during fabrication, and then liberated by laser ablation, heating, and/or other suitable process to liberate the droplet, of liquid metal allowing it to migrate inwardly towards the inner portion 134.

Figure 9:
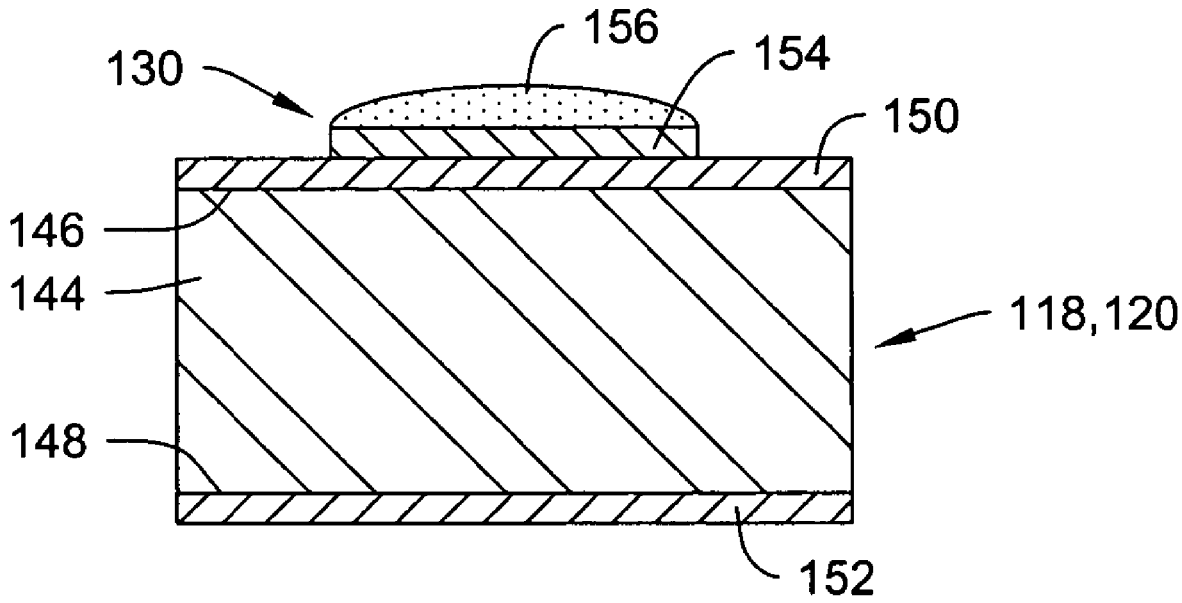
FIG. 9 is a cross-sectional view showing the configuration of the liquid contact regions on the upper and lower actuating surfaces of FIG. 8.

FIG. 9 is a cross-sectional view showing the configuration of the liquid contact regions 130 on the upper and lower actuating surfaces 118 and 120 of FIG. 8. As can be seen in FIG. 9, the upper and lower actuating surfaces 118 and 120 may each include a base layer 144 having a leading surface 146 and a trailing surface 148. In certain embodiments, the base layer 144 can be formed from an approximately 1 micron thick layer of silicon nitride (SiN) film. A relatively thin (e.g. 50 nm) outer layer 150 formed above the leading surface 146 of the base layer 144 includes a non-wetable material such as tungsten that resists wetting of certain types of liquid metals such as liquid gallium. A similar outer layer 152 formed on the trailing surface 148 can also be provided in certain embodiments, if desired.

As can be further seen in FIG. 9, each liquid contact region 130 includes a wetable surface 154 adapted to wet with a semi-spherically shaped droplet of liquid metal 156 thereon, similar to that described above with respect to FIG. 4. The wetable surface 154 should typically include a material that wets well with the liquid metal 156. In certain embodiments, for example, the wetable surface 154 can include a layer of platinum or other suitable material that wets well with liquid gallium.

The switch 108 can be configured to operate in a manner similar to that described above with respect to the illustrative switch 10 of FIG. 1. An electric charge applied to the electrodes on the support legs 122,124 causes the upper and lower actuating surfaces 118,120 to displace towards each other bringing the liquid metal 156 located on the various liquid contact regions 130 into contact. When this occurs, an RF signal received at an input terminal 158 on the upper switch cavity 112 can be delivered through a number of electrical lines 160,162 to an output terminal 164 on the lower switch cavity 114. As discussed herein, the liquid metal 156 can be configured to self-heal after each actuation cycle through a process of atomic recapture (FIGS. 5A–5E) and a process of surface rearrangement (FIGS. 6A–6E). The addition of heat in certain embodiments may further aid in allowing the switch to self-heal after each actuation cycle, if desired.

Figure 10A:
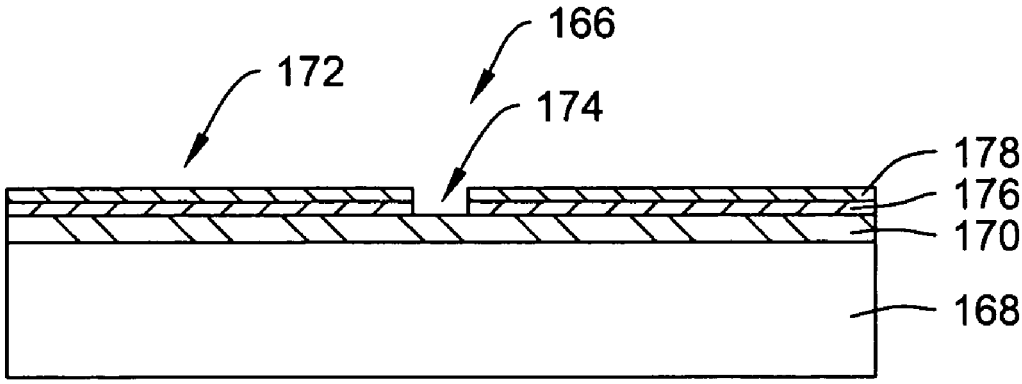
FIGS. 10A–10O are schematic views showing an illustrative method of forming a self-healing liquid contact switch.
Figure 10B:
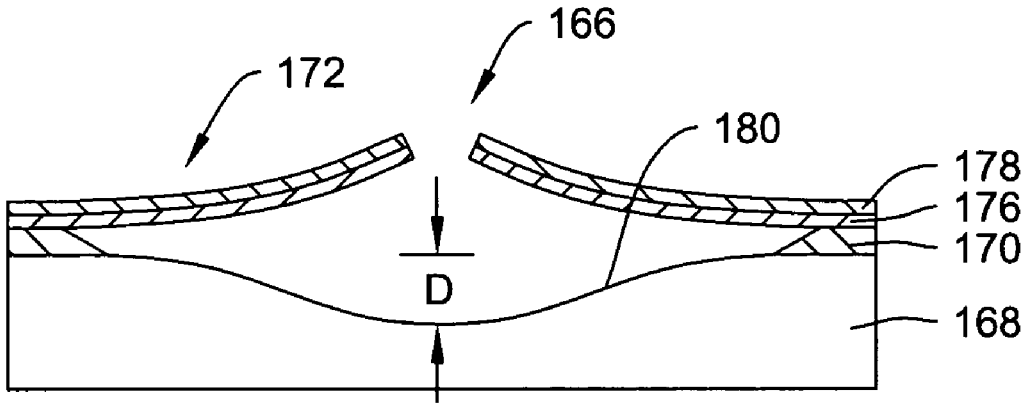
Figure 10C:
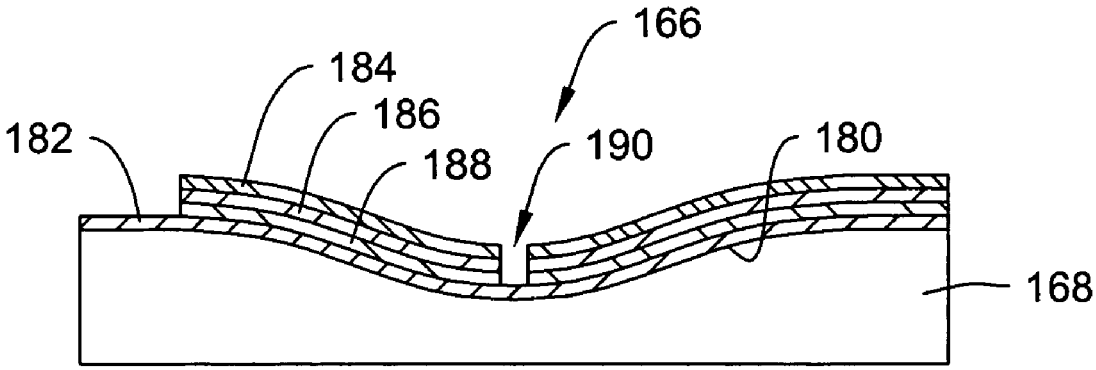
Figure 10D:
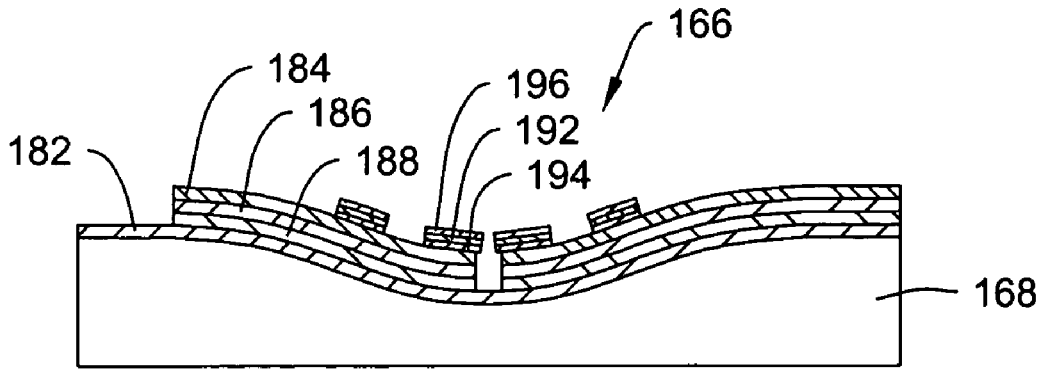
Figure 10E:
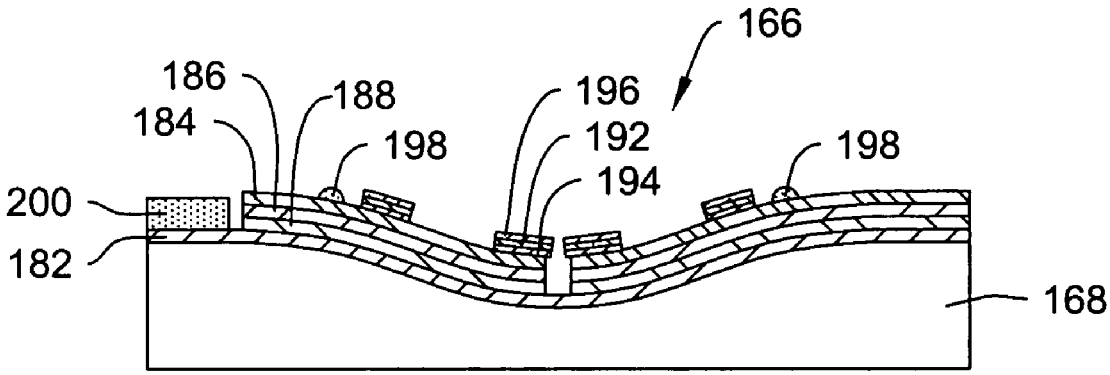
Figure 10F:
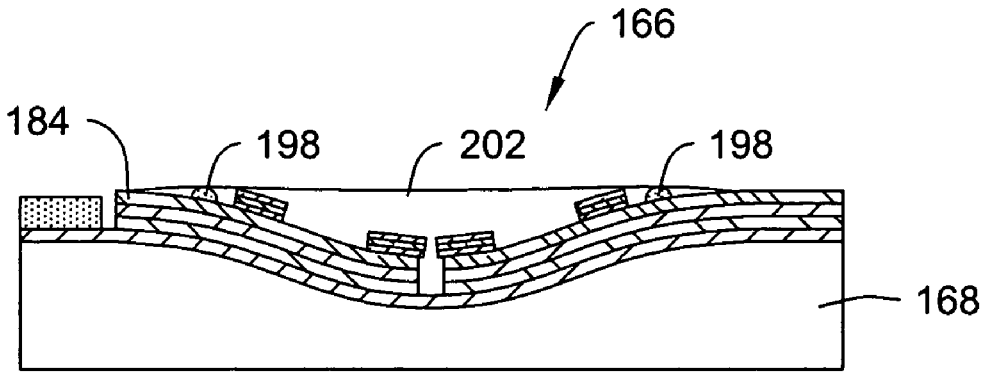
Figure 10G:
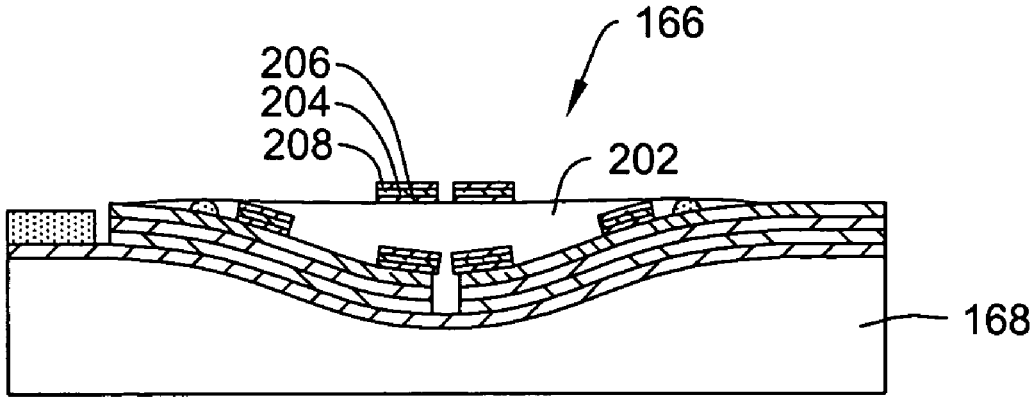
Figure 10H:
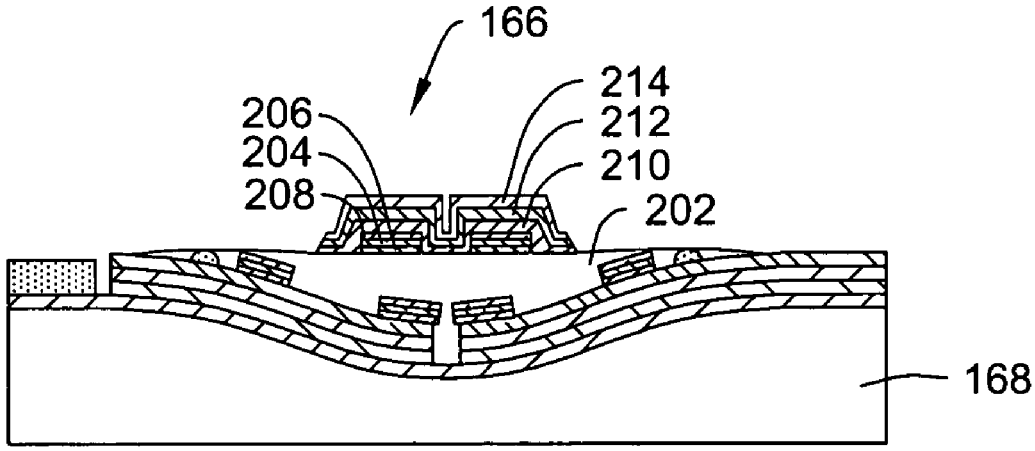
Figure 10I:
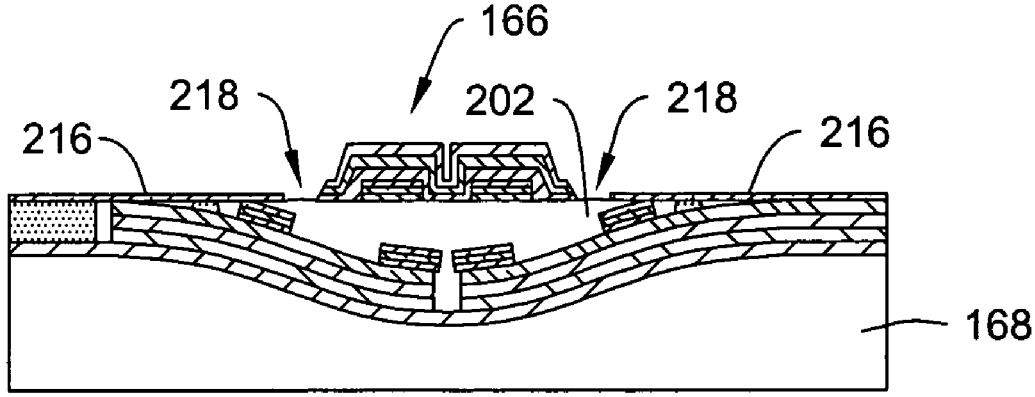
Figure 10J:
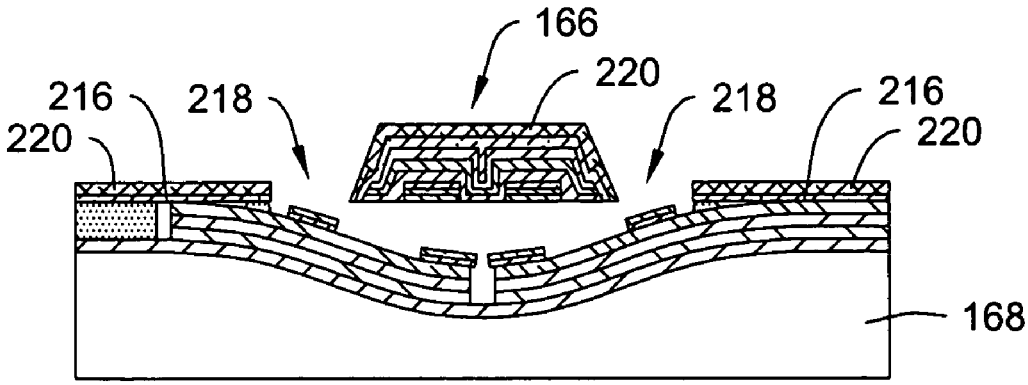
Figure 10K:
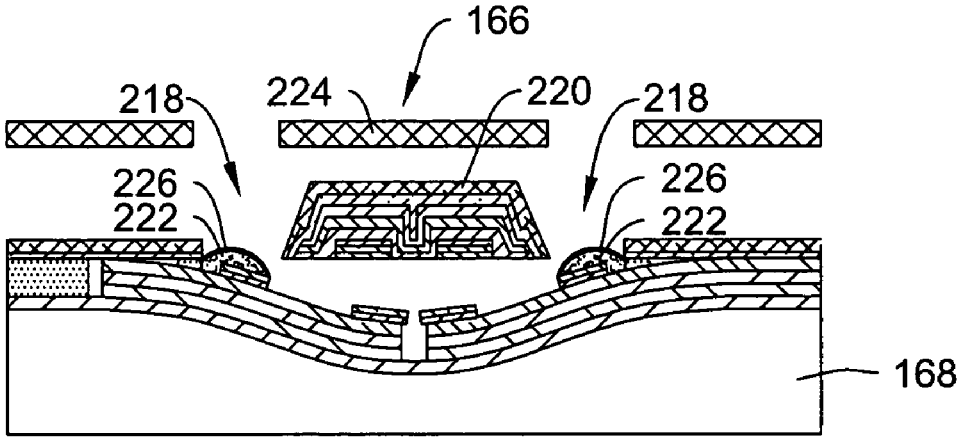
Figure 10L:
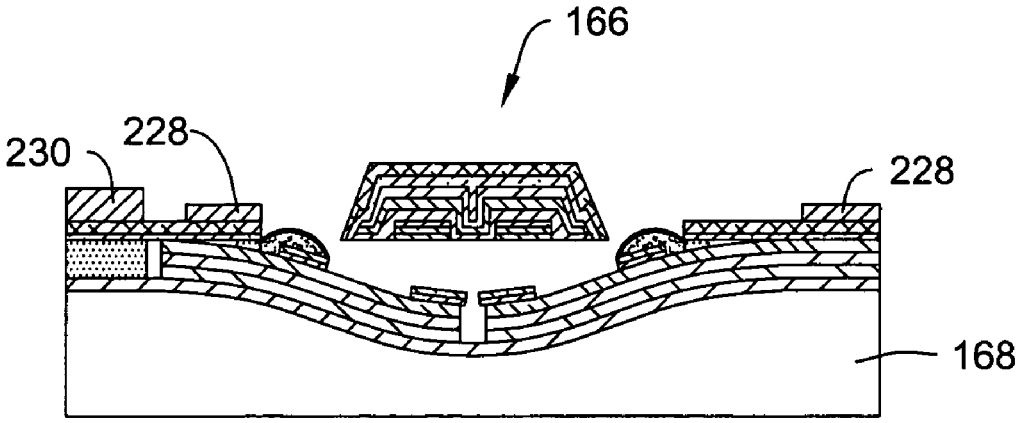
Figure 10M:
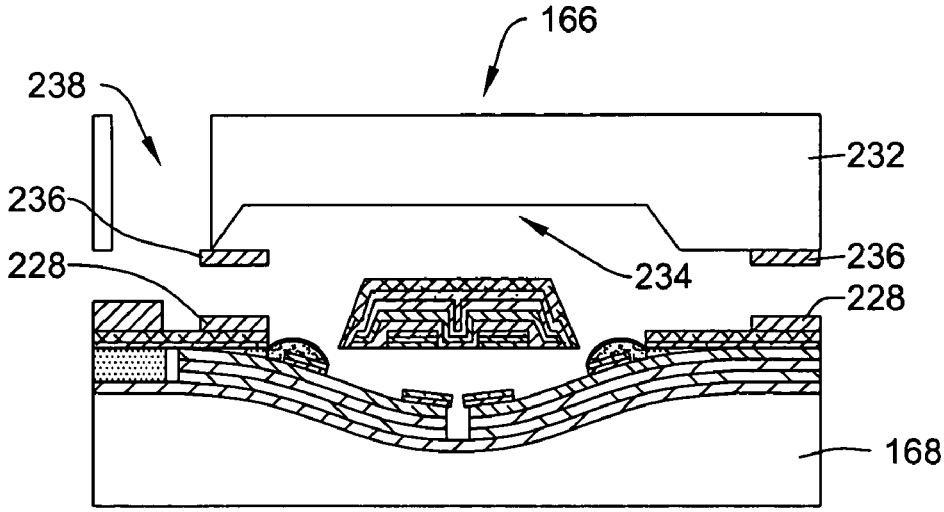
Figure 10N:
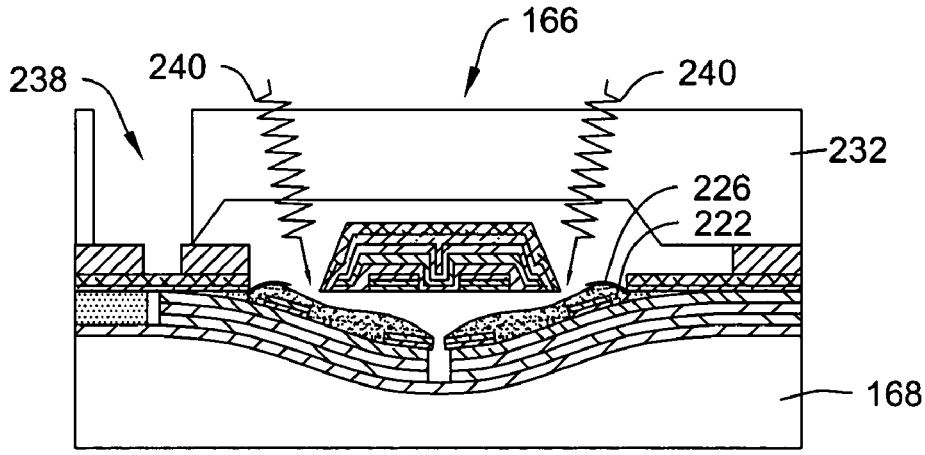
Figure 10O:
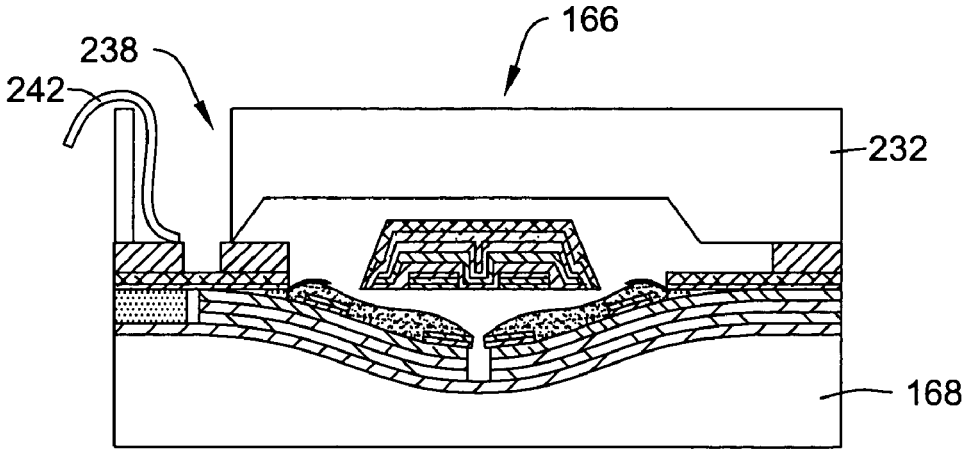

FIGS. 10A–10O are schematic cross-sectional side views showing an illustrative method of forming a self-healing liquid contact switch. The method, represented generally by reference number 166, begins with the step of providing a substrate 168 having a sacrificial control layer 170 and a photomask 172 having one or more openings 174 formed therein. In certain embodiments, the photomask 172 can include a first photomask layer 176 of silicon nitride (SiN) and a second photomask layer 178 of polysilicon that can be applied over the control layer 170 in a manner that permits the photomask 172 to bimorph during subsequent etching steps.

Once the control layer 170 and photomask 172 are formed over the substrate 168, a custom sloped etch can then be formed within the surface of the substrate 168. As can be seen in a subsequent step in FIG. 10B, for example, a custom sloped surface 180 having a gradually sloping S-shaped contour can be etched within the substrate 168, similar to the custom sloped surface 48 depicted in FIG. 1. Formation of the custom sloped surface 180 can be accomplished in a manner, but preferably similar to that described in co-pending U.S. patent application Ser. No. 10/739,521, entitled "Equipment And Process For Creating A Custom Sloped Etch In A Substrate", which is incorporated herein by reference. The depth D at which the custom sloped surface 180 is recessed within the substrate 168 can be made relatively large (e.g. about 4 to 8 microns) to permit the actuating switch surfaces sufficient room to displace.

FIG. 10C is a schematic view showing the formation of several metal layers above the substrate 168 that can be used in forming a lower actuating surface (e.g. the lower actuating surface 32 of FIG. 1). As can be seen in FIG. 10C, the remaining control layer 170 and photomask layer 172 can be removed, allowing the formation of a base layer 182 of silicon nitride (SiN) onto the sloped surface 180 of the substrate 168. An outer layer 184 of tungsten or other non-wetable material can then be formed over the substrate 168 along with one or more intermediate layers 186,188 disposed between the outer layer 184 and the sloped surface 180 of the substrate 168. In certain embodiments, for example, a first intermediate 186 layer of gold can be formed above a second intermediate layer 188 of chrome that facilitates bonding to the base layer 182. A small gap 190 can be formed within each of the layers 184,186,188 to electrically isolate the input and output portions of the lower actuating surface, once formed.

FIG. 10D is a schematic view showing the initial formation of several liquid contact regions above the outer layer 184. As shown in FIG. 10D, a wetable layer 192 of platinum or other suitable material can be formed above an intermediate layer 194 of chrome that facilitates bonding to the outer layer 184. A sacrificial outer layer 196 of titanium may also be provided above the wetable layer 194 to prevent the wetable layer 192 from oxidizing during fabrication. This process can then be repeated a number of times to form multiple liquid contact regions onto the outer surface 184, gradually increasing the size of each liquid contact region towards the interior of the substrate 168.

FIG. 10E is a schematic view showing the formation of a number of spacer elements 198 above the substrate 168. The spacer elements 198 can be formed by sputtering a number of protrusive dots of silicon nitride (SiN) or other suitable material above the outer periphery of the outer layer 184 at a location away from the layers 192,194,196 used in forming the liquid contacts. The spacer elements 198 should be of sufficient size to prevent the upper and lower actuating surfaces from physically contacting each during electrostatic actuation. A small amount of SiN may also be formed at location 200 to assist in bonding an optional wire lead 242 (FIG. 10O) to the switch in later fabrication steps.

FIGS. 10F–10G are schematic views showing the formation of several liquid contact regions on the upper actuating surface. In FIG. 10F, a sacrificial material 202 is shown deposited over the spacer elements 198 and the outer layer 184, allowing the formation of the upper actuating electrode and upper actuating surface of the switch. The sacrificial material 202 may be formed by any number of suitable techniques, including, for example, a tetraethoxysilane (TEOS) deposition technique followed by a chemical mechanical polishing (CMP) step.

Once the sacrificial material 202 has been deposited, a number of metal layers 204,206,208 can then be formed over the sacrificial material 202 to form the liquid contact regions on the upper actuating surface, as shown, for example, in FIG. 10G. Similar to the layers 184,186,188 formed in the step of FIG. 10D, a wetable layer 204 of platinum or other suitable material can be sandwiched between a layer of chrome 206 and a sacrificial layer 208 of titanium. The process can then be repeated a number of times to form multiple liquid regions, each increasing in size as discussed herein.

FIGS. 10H–10J are schematic views showing the formation of the upper actuating electrode above the substrate 168. Similar to the layers 184,186,188 formed in the illustrative step of FIG. 10C, an outer (i.e. wetable) layer 210 of tungsten or other suitable material can be formed, along with a first intermediate layer 212 of gold and a second intermediate layer 214 of chrome. In a subsequent step illustrated in FIG. 10I, a layer 216 of tungsten or other non-wetable material is then deposited above the substrate 168, forming, for example, the metal layer 16 of the upper actuating electrode 12 illustrated in FIG. 1. The sacrificial material 202 can then be removed, and a base layer 220 of silicon nitride (SiN) or other suitable material formed above the outer layer 216. One or more openings 218 can be formed through the outer layer 216 to permit the deposition of liquid metal.

FIG. 10K is a schematic view showing the deposition of liquid metal 222 onto several of the lower liquid contact regions. As shown in FIG. 10K, a shadow mask 224 may be utilized to cover all but the openings 218, allowing the deposition of a liquid metal 222 onto one or more of the liquid contact regions. To prevent oxidation at this stage, the liquid metal 222 can be encapsulated within a layer 226 of tungsten or other suitable encapsulating material. The liquid metal 222 can be maintained at a sufficiently low temperature to keep the material in a solid phase, if necessary.

FIGS. 10L–10M are schematic views illustrating the process of hermetically sealing the formed structure within an enclosure. In preparation for sealing, a metal solder seal 228 may be provided at both ends of the upper actuating electrode, as shown, for example, in FIG. 10L. A bonding pad 230 can also be formed above the substrate 168 to permit the switch to be wired to other components, if desired.

As shown in a subsequent step in FIG. 10M, a transparent substrate 232 (e.g. quartz, glass, etc.) having an internal recess 234 formed therein can be bonded to the substrate 168 using a number of metal solder seals 236 corresponding with the metal solder seals 228 formed in the prior step of FIG. 10L. The process of bonding the transparent substrate 232 to the substrate 168 can be accomplished within a low-pressure (e.g. 20 to 30 torr) atmosphere of argon gas. If desired, a small hole 238 can also be formed within the transparent substrate 232 to accommodate an optional wire lead 242 (FIG. 10O).

Once the liquid metal 222 has been hermetically sealed, the liquid metal 222 can then be liberated from within the encapsulating layer 226, allowing the liquid metal 222 to flow onto the various liquid contact regions vis-à-vis the surface tension of the liquid metal 222, as shown, for example, in FIG. 10N. Release of the liquid metal 222 can be accomplished by directing one or more laser beams 240 through the transparent substrate 232 to thermally ablate the encapsulating layer 226. Alternatively, one or more heater elements (e.g. heating resistors) disposed within the switch can be used to heat the encapsulating layer 226 beyond its melting point, causing the liquid metal 222 to flow inwardly towards the other liquid contact regions. As can be seen in a further processing step in FIG. 10O, the formed structure can then be wired using an optional wire lead 242 that can be threaded through the opening 238 in the transparent substrate 232.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes may be made in details, particularly in matters of shape, size and arrangement of parts without exceeding the scope of the invention.

What is claimed is:

1. A self-healing liquid contact switch, comprising:

an upper actuating surface including a first plurality of liquid contact regions;

a lower actuating surface including a second plurality of liquid contact regions spaced apart from said first plurality of liquid contact regions;

one or more wetable traces interconnecting said first and second plurality of liquid contact regions; and a liquid metal disposed within the space between the upper and lower actuating surfaces, said liquid metal being configured to wet with said first and second plurality of liquid contact regions to electrically actuate the switch.

2. The self-healing liquid contact switch of claim 1, wherein each of said first and second plurality of liquid contact regions are arranged in increasing size from an outer periphery of said upper and lower actuating surfaces to an inner portion thereof.

3. The self-healing liquid contact switch of claim 2, wherein said first and second plurality of liquid contact regions increase in size from 2 microns at said outer periphery to 3 microns at said inner portion.

4. The self-healing liquid contact switch of claim 1, wherein each of said first and second plurality of liquid contact regions includes a wetable layer of platinum.

5. The self-healing liquid contact switch of claim 1, wherein said liquid metal includes liquid gallium.

6. The self-healing liquid contact switch of claim 1, wherein said first and second plurality of liquid contact regions each include a pattern of liquid contact regions.

7. The self-healing liquid contact switch of claim 6, wherein said pattern of liquid contact regions comprises a patterned array of linearly converging lines.

8. The self-healing liquid contact switch of claim 6, wherein said pattern of liquid contact regions comprises a spiraled pattern of liquid contact regions.

9. The self-healing liquid contact switch of claim 1, wherein said one or more wetable traces are tapered.

10. The self-healing liquid contact switch of claim 1, further comprising an upper and lower actuating electrode each including one or more metal layers coupled to a base layer.

11. The self-healing liquid contact switch of claim 10, further comprising a pattern of getter dots disposed on at least one of said upper and lower actuating electrodes.

12. The self-healing liquid contact switch of claim 10, further comprising a number of spacer elements disposed on at least one of said upper and lower actuating electrodes.

13. The self-healing liquid contact switch of claim 10, wherein at least one of said upper and lower actuating electrodes includes a custom sloped surface.

14. The self-healing liquid contact switch of claim 13, wherein said custom sloped surface includes an S-shaped sloped surface.

15. The self-healing liquid contact switch of claim 13, wherein said custom sloped surface is recessed with the upper and/or lower actuating electrodes at a depth of about 4 to 8 microns.

16. The self-healing liquid contact switch of claim 1, further including a hermetically sealed enclosure containing argon gas.

17. The self-healing liquid contact switch of claim 1, further comprising heating means for heating said upper and lower actuating surfaces.

18. The self-healing liquid contact switch of claim 17, wherein said heating means includes one or more heater elements arranged about the upper and/or lower actuating surfaces.

19. The self-healing liquid contact switch of claim 1, wherein each of said upper and lower actuating surfaces includes a leading surface and a trailing surface.

20. The self-healing liquid contact switch of claim 19, wherein said leading surface includes a non-wetable layer of tungsten.

21. A self-healing liquid contact switch, comprising:

an upper actuating surface operatively coupled to an upper actuating electrode, said upper actuating surface including a first plurality of liquid contact regions;

a lower actuating surface operatively coupled to a lower actuating electrode, said lower actuating surface including a second plurality of liquid contact regions spaced apart from said first plurality of liquid contact regions;

one or more wetable traces interconnecting said first and second plurality of liquid contact regions; and a liquid metal disposed within the space between the upper and lower actuating surfaces, said liquid metal being configured to wet with said first and second plurality of liquid contact regions to electrically actuate the switch.

22. The self-healing liquid contact switch of claim 21, wherein each of said first and second plurality of liquid contact regions are arranged in increasing size from an outer periphery of said upper and lower actuating surfaces to an inner portion thereof.

23. The self-healing liquid contact switch of claim 22, wherein said first and second plurality of liquid contact regions increase in size from 2 microns at said outer periphery to 3 microns at said inner portion.

24. The self-healing liquid contact switch of claim 21, wherein each of said first and second plurality of liquid contact regions includes a wetable layer of platinum.

25. The self-healing liquid contact switch of claim 21, wherein said liquid metal includes liquid gallium.

26. The self-healing liquid contact switch of claim 21, wherein said first and second plurality of liquid contact regions each include a pattern of liquid contact regions.

27. The self-healing liquid contact switch of claim 26, wherein said pattern of liquid contact regions comprises a patterned array of linearly converging lines.

28. The self-healing liquid contact switch of claim 26, wherein said pattern of liquid contact regions comprises a spiraled pattern of liquid contact regions.

29. The self-healing liquid contact switch of claim 21, wherein said one or more wetable traces are tapered.

30. The self-healing liquid contact switch of claim 21, further comprising a pattern of getter dots disposed on at least one of said upper and lower actuating electrodes.

31. The self-healing liquid contact switch of claim 21, further comprising a number of spacer elements disposed on at least one of said upper and lower actuating electrodes.

32. The self-healing liquid contact switch of claim 21, wherein at least one of said upper and lower actuating electrodes includes a custom sloped surface.

33. The self-healing liquid contact switch of claim 32, wherein said custom sloped surface includes an S-shaped sloped surface.

34. The self-healing liquid contact switch of claim 32, wherein said custom sloped surface is recessed with the upper and/or lower actuating electrodes at a depth of about 4 to 8 microns.

35. The self-healing liquid contact switch of claim 21, further including a hermetically sealed enclosure containing argon gas.

36. The self-healing liquid contact switch of claim 21, further comprising heating means for heating said upper and lower actuating surfaces.

37. The self-healing liquid contact switch of claim 36, wherein said heating means includes one or more heater elements arranged about the upper and/or lower actuating surfaces.

38. The self-healing liquid contact switch of claim 21, wherein each of said upper and lower actuating surfaces includes a leading surface and a trailing surface.

39. The self-healing liquid contact switch of claim 38, wherein said leading surface includes a non-wetable layer of tungsten.

40. A self-healing liquid contact switch, comprising:

an upper actuating surface operatively coupled to an upper actuating electrode, said upper actuating surface including a first plurality of liquid contact regions;

a lower actuating surface operatively coupled to a lower actuating electrode, said lower actuating surface including a second plurality of liquid contact regions spaced apart from said first plurality of liquid contact regions; and a liquid metal disposed within the space between the upper and lower actuating surfaces, said liquid metal being configured to wet with said first and second plurality of liquid contact regions to electrically actuate the switch;

wherein at least one of said upper and lower actuating electrodes includes an S-shaped sloped surface.

41. A self-healing liquid contact switch, comprising:

an upper actuating surface operatively coupled to an upper actuating electrode, said upper actuating surface including a first plurality of liquid contact regions increasing in size from an outer periphery of said upper surface to an inner portion thereof;

a lower actuating surface operatively coupled to a lower actuating electrode, said lower actuating surface including a second plurality of liquid contact regions spaced apart from said first plurality of liquid contact regions, each of said second plurality of liquid contact regions increasing in size from an outer periphery of said lower actuating surface to an inner portion thereof; and a liquid metal disposed within the space between the upper and lower actuating surfaces, said liquid metal being configured to wet with said first and second plurality of liquid contact regions to electrically actuate the switch.

42. A self-healing liquid contact MEMS RF switch, comprising:

an upper diaphragm including a first plurality of liquid contact regions;

a lower diaphragm including a second plurality of liquid contact regions spaced apart from said first plurality of liquid contact regions;

one or more wetable traces interconnecting said first and second plurality of liquid contact regions; and a liquid metal disposed within the space between the upper and lower diaphragms, said liquid metal being configured to wet with said first and second plurality of liquid contact regions to electrically actuate the switch.

43. The self-healing liquid contact MEMS RF switch of claim 42, wherein each of said first and second plurality of liquid contact regions are arranged in increasing size from an outer periphery of said upper and lower diaphragm to an inner portion thereof.

44. The self-healing liquid contact MEMS RF switch of claim 43, wherein said first and second plurality of liquid contact regions increase in size from 2 microns at said outer periphery to 3 microns at said inner portion.

45. The self-healing liquid contact MEMS RF switch of claim 42, wherein each of said first and second plurality of liquid contact regions includes a wetable layer of platinum.

46. The self-healing liquid contact MEMS RF switch of claim 42, wherein said liquid metal includes liquid gallium.

47. The self-healing liquid contact MEMS RF switch of claim 42, wherein said first and second plurality of liquid contact regions each include a pattern of liquid contact regions.

48. The self-healing liquid contact MEMS RF switch of claim 47, wherein said pattern of liquid contact regions comprises a patterned array of linearly converging lines.

49. The self-healing liquid contact MEMS RF switch of claim 47, wherein said pattern of liquid contact regions comprises a spiraled pattern of liquid contact regions.

50. The self-healing liquid contact MEMS RF switch of claim 42, wherein said one or more wetable traces are tapered.

51. The self-healing liquid contact MEMS RF switch of claim 42, further comprising an upper and lower actuating electrode each including one or more metal layers coupled to a base layer.

52. The self-healing liquid contact MEMS RF switch of claim 51, further comprising a pattern of getter dots disposed on at least one of said upper and lower actuating electrodes.

53. The self-healing liquid contact MEMS RF switch of claim 51, further comprising a number of spacer elements disposed on at least one of said upper and lower actuating electrodes.

54. The self-healing liquid contact MEMS RF switch of claim 51, wherein at least one of said upper and lower actuating electrodes includes a custom sloped surface.

55. The self-healing liquid contact MEMS RF switch of claim 54, wherein said custom sloped surface includes an S-shaped sloped surface.

56. The self-healing liquid contact MEMS RF switch of claim 54, wherein said custom sloped surface is recessed with the upper and/or lower actuating electrodes at a depth of about 4 to 8 microns.

57. The self-healing liquid contact MEMS RF switch of claim 42, further including a hermetically sealed enclosure containing argon gas.

58. The self-healing liquid contact MEMS RF switch of claim 42, further comprising heating means for heating said upper and lower diaphragms.

59. The self-healing liquid contact MEMS RF switch of claim 58, wherein said heating means includes one or more heater elements arranged about the upper and/or lower diaphragms.

60. The self-healing liquid contact MEMS RF switch of claim 42, wherein each of said upper and lower diaphragms includes a leading surface and a trailing surface.

61. The self-healing liquid contact MEMS RF switch of claim 60, wherein said leading surface includes a non-wetable layer of tungsten.

62. A self-healing liquid contact MEMS RF switch, comprising:

a hermetically sealed enclosure containing argon gas;

an upper diaphragm disposed within the enclosure and including a first plurality of liquid contact regions;

a lower diaphragm disposed within the enclosure and including a second plurality of liquid contact regions spaced apart from said first plurality of liquid contact regions; and one or more wetable traces interconnecting said first and second plurality of liquid contact regions; and a liquid metal disposed within the space between the upper and lower actuating surfaces, said liquid metal being configured to wet with said first and second plurality of liquid contact regions to electrically actuate the switch;

wherein said first and second plurality of liquid contact regions comprise a spiraled pattern of liquid contact regions.

* * * * *

UNITED STATES PATENT AND TRADEMARK OFFICE

CERTIFICATE OF CORRECTION

PATENT NO. : 7,189,934 B2
APPLICATION NO. : 10/749255
DATED : March 13, 2007
INVENTOR(S) : Daniel W. Youngner It is certified that error appears in the above-identified patent and that said Letters Patent is hereby corrected as shown below:

In column 1, line 8, please add: --The U.S. Government may have certain rights in the present invention as provided for by the terms of Government Contract # F29601-03-C-0327 awarded by the United States Air Force.--

Signed and Sealed this

Eighteenth Day of March, 2008

JON W. DUDAS
*Director of the United States Patent and Trademark Office*